US005275040A

United States Patent [19]

Codazzi

[11] Patent Number: 5,275,040

[45] Date of Patent: Jan. 4, 1994

[54] METHOD OF AND APPARATUS FOR DETECTING AN INFLUX INTO A WELL WHILE DRILLING

[75] Inventor: Daniel Codazzi, Missouri City, Tex.

[73] Assignee: Anadrill, Inc., Sugar Land, Tex.

[21] Appl. No.: 714,103

[22] Filed: Jun. 11, 1991

Related U.S. Application Data

[63] Continuation-in-part of Ser. No. 546,272, Jun. 29, 1990, Pat. No. 5,154,078.

[51] Int. Cl.[5] ..... E21B 47/00; G01V 1/00

[52] U.S. Cl. ..... 73/155; 166/250; 367/83

[58] Field of Search ..... 73/151, 153, 155, 19.09, 73/579, 597, 602; 166/250; 175/48; 367/81, 83, 34

[56] References Cited

U.S. PATENT DOCUMENTS

| | | | |
|---|---|---|---|
| 2,560,911 | 7/1951 | Wolf | 177/352 |
| 2,573,390 | 10/1951 | Blanchard | 73/19.1 |
| 3,603,145 | 9/1971 | Morris | 73/155 |
| 3,789,355 | 1/1974 | patton | 340/18 LD |
| 4,003,256 | 1/1977 | Donelan et al. | 73/560 |
| 4,208,906 | 6/1980 | Roberts, Jr. | 73/155 |
| 4,273,212 | 6/1981 | Dorr et al. | 73/151 |
| 4,286,461 | 9/1981 | Bres et al. | 73/155 |
| 4,299,123 | 11/1981 | Dowdy | 73/155 |
| 4,520,665 | 6/1985 | Cordier et al. | 73/155 |
| 4,527,425 | 7/1985 | Stockton | 73/155 |
| 4,733,232 | 3/1988 | Grosso | 73/155 |
| 4,733,233 | 3/1988 | Grosso et al. | 73/155 |
| 4,934,186 | 6/1990 | McCoy | 73/151 |
| 5,081,613 | 1/1992 | Holzhausen et al. | 73/151 |

OTHER PUBLICATIONS

Robert Desbrandes et al., "MWD Monitoring of Gas Kicks Ensures Safer Drilling", Petroleum Engineer International, Jul. 1987.

T. M. Bryant, "MWD Acoustic and Mud Resistivity Measurements for Gas Influx Detection", Teleco Oilfield Services, Inc., 1989.

*Primary Examiner*—Hezron E. Williams
*Assistant Examiner*—George Dombroske
*Attorney, Agent, or Firm*—Gary L. Bush; Wayne I. Kanak; John J. Ryberg

[57] ABSTRACT

Gas influx into a wellbore, which is commonly referred to as a "kick", is detected during active drilling of the borehole. In a preferred embodiment of the invention a determination of mud pump noise round trip transit time T by evaluating a function $T=(n-\Phi/2\pi)f$ where $\Phi$ is the phase between standpipe and annulus signals and f is the frequency of a drill fluid oscillation caused by a mud pump and n is an integer which is incremented or decremented until the rate of change of T with respect to frequency is zero. An alarm signal is generated when the rate of change of T with respect to time exceeds a predetermined threshold. In another embodiment of the invention a determination of the Doppler frequency shift of a mud pump signal expressed as a ratio signal, $\Delta f/f_0$ where $\Delta f$ is the change in frequency measured at the annulus from the frequency $f_0$ of the mud pump signal measured at the standpipe. The ratio is compared with a threshold signal to determine whether or not gas influx has entered the annulus.

6 Claims, 13 Drawing Sheets

INFORMATION SIGNAL
PHASE SHIFT MODULATOR Δ Ø
CARRIER SIGNAL (fc)
PHASE
BANDPASS FILTER
fc
AMPLITUDE MODULATION

MUD 62
COMMUNICATION TRANSMITTER 80
MUD SUB 60
9
PHASE MODU-LATION SIGNAL
BANDPASS
PM → AM
AMPLITUDE MODU-LATION SIGNAL

201
START
ACCEPT
DEPTH, MUD, WEIGHT
227
ACQUISITION
APT: a(t), SPT: s(t)
203
FFT
A(F), S(F)
205
ESTIMATE
ni = [2(d/c)fi]
225
IDENTIFY FREQUENCIES
fi, i=1.....N
207
211
CROSS-SPECTRUM
Csa = SA*
209
COHERENCE
Gsa = √CsaCsa*/CssCaa
PHASE
ϕ = tan-1(Im(Csa)/Re(Csa))
213
UNWRAP ϕ
215
LOOP ON
TIME t
CALCULATE TIME
Ti=(ni-ϕi/2π)/fi
217
ni=ni-1
>0
dTi/dfi
>0
ni = ni+1
219
=0
231
221
229
dT/dt = ΣdTi/dt Csa/ΣCsa
ALARM IF dT/dt >12ms/mn
223

FIG. 13
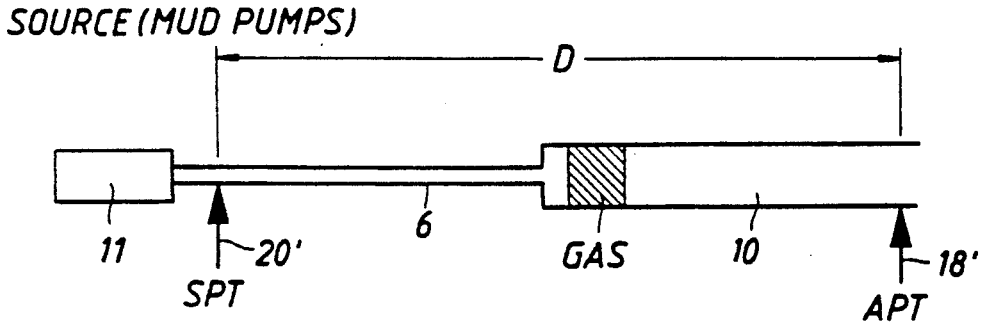
FIG. 14A
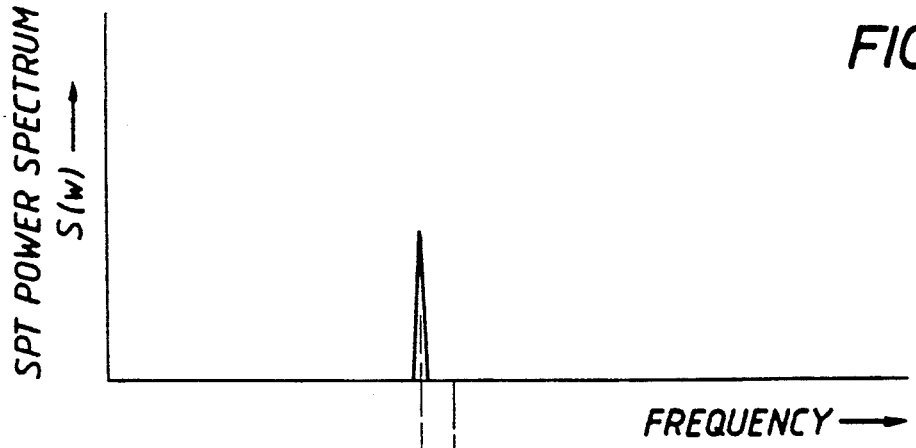
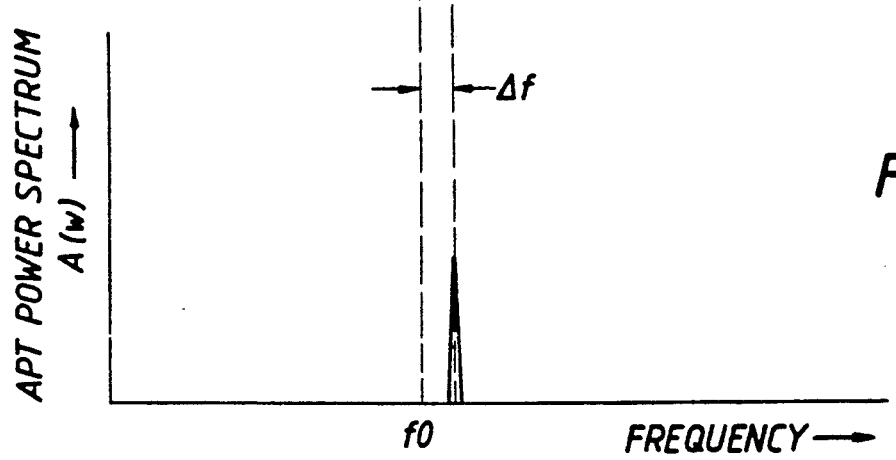
FIG. 14B

METHOD OF AND APPARATUS FOR DETECTING AN INFLUX INTO A WELL WHILE DRILLING

CROSS-REFERENCE TO RELATED APPLICATION

This application is a Continuation-In-Part application of co-pending parent application U.S. Ser. No. 07/546,272 filed on Jun. 29, 1990, now U.S. Pat. No. 5,154,078.

TECHNICAL FIELD

The present invention relates to the detection of a fluid influx, particularly a gas influx or "kick," into the borehole of an oil or gas well. More particularly, the present invention relates to methods of and apparatus for the acoustic detection of a gas influx during the drilling of the borehole.

BACKGROUND OF THE INVENTION

Normally, hydrostatic pressure of the drilling fluid column in a well is greater than pressure of formation fluids, thus preventing flow of formation fluids into the wellbore. When the hydrostatic pressure drops below the formation-fluid pressure, the formation fluids can enter the well. If this flow is relatively small and causes a decrease in the density of the mud as measured at the surface, the drilling fluid is said to be "gas cut", "salt-water cut", or "oil cut" as the case may be. When a noticeable increase in mud-pit volume occurs, the typical prior art method of gas influx detection, the event is known as a "kick". An uncontrolled flow of formation fluids into the wellbore and up to the surface is a "blow-out".

As long as hydrostatic pressure controls the well, circulation is accomplished by using a flowline, or the well may be left open while the bit is removed. If a kick occurs, blowout-prevention equipment and accessories are needed to close the well. This may be done with an annular preventer, with pipe rams, or with master (blind) rams when the drill pipe is out of the hole.

In addition, means are necessary to pump drilling fluid into the well and to allow controlled escape of fluids. Injection is accomplished either down the drill pipe or through one of the kill lines, and flow from the well is controlled by a variable orifice or choke attached to a choke line. Choke lines are arranged so that well effluent can be routed to either a reserve pit where undesired fluid is discarded, or to a mud/gas separator, degasser, and mud pit where desired fluid is degassed and saved. By using this equipment, the low-density fluids are removed and replaced with a higher-density fluid capable of controlling the well.

As mentioned above, kick detection while drilling in the past has typically been indicated by observing and monitoring the mud return flow rate and/or mud pit volume. Accordingly, most rigs which use drilling mud to control the pressure in the borehole have some form of pit-level indicating device to indicate a gain or loss of mud. A mud pit-level indicating and recording device such as a chart is usually located in a position so that the driller can see the chart while drilling is occurring. When a kick occurs, the surface pressure required to contain it will largely depend upon closing in the BOP's quickly and retaining as much mud as possible in the well.

A flow meter showing relative changes in return-mud flow has also been used as a warning device, because mud hold-up in solids control devices, degassers, and mixing equipment affects average pit-level. Such fluctuations in pit-level due to such factors recur periodically during drilling and may occur simultaneously with a kick. When such conditions are present, a return-flow rate may be the first indication of a kick.

To determine kicks as early as possible while drilling, the driller typically uses instantaneous charts of average volume of the mud pit, mud gained or lost from the pit, and return-flow rate. Preferably, the pit volume and return flow rate are recorded on the drilling floor so that trends can be established. As soon as an unexpected change in the trends of such parameters occurs, the driller checks for a kick condition.

Because a kick can lead to a blowout with possible disastrous results to the well, prior attempts have been made to obtain information as to a gas influx into the borehole before such influx affects pit mud volume or return flow rate. For example, U.S. Pat. Nos. 4,733,233 to Grosso and Feeley and 4,733,232 to Grosso describe a technique by which a pressure transducer at the surface senses annulus acoustic variations in the returning mud flow and another pressure transducer at the surface senses drill string acoustic variations in the entering mud flow. In the '232 patent, a downhole "wave generator" produces an acoustic signal in the sonic range. The signal is measured at the surface in the drill string and in the annulus. Changes in the measured difference between amplitude and phase of the annulus and drill string signals are said to indicate that fluid influx into the annulus has occurred.

In the '233 patent, a downhole MWD transmitter produces a train of pulses in the sub-sonic or sonic frequency range. The pulse trains are sensed at the surface in the annulus and in the drill string or standpipe with pressure transducers. A change in the amplitude of the annulus signal where no change occurs in the amplitude of the drill string signal is used to indicate the presence of a borehole fluid influx. A change in phase angle between the surface received annulus signal and the surface received drill string signal is also used to indicate a borehole fluid influx.

Such amplitude and phase comparisons of annulus and drill string surface signals which travel upwardly through the annulus and drill string respectively from an MWD communication transmitter are believed to be inaccurate under many circumstances. Amplitude comparisons of such signals are difficult in the real world environment of a drilling rig and deep borehole due to noise which is simultaneously measured in the annulus and drill string, and also due to variations between annulus and drill string mud temperature. The phase difference between the annulus and drill string signals is inherently ambiguous because the phase of the annulus signal may be less than or greater than 360° ($2\pi$) from that of the drill string.

The '233 patent suggests that a correlation function may be obtained between the annulus and drill string signals and that such signals have a fixed time relationship $\tau$. The patent further suggests that characteristics of the annulus and drill string may be precisely determined on a continuous basis while drilling and that if characteristics of the annulus and drill string signals are disturbed in excess of a predetermined limit, an alarm may be energized. Unfortunately, a direct correlation process as suggested by the '233 patent has been found to be useless without an explanation as to how the annulus and drill string signals are to be "conditioned" prior to the correlation process.

Another technique for determining fluid influx into the borehole while drilling is disclosed in U.S. Pat. No. 4,273,212. This patent discloses energizing a transducer to propagate an acoustic signal down the annulus between the borehole and the drill string. A receiver is provided to receive reflected acoustic energy at the surface. Such acoustic energy is reflected from the bottom of the hole and also from the interface between drilling fluid in the annulus and fluid influx. This technique is believed not to be feasible in a real drilling rig environment due to the difficulty of distinguishing reflections from the bottom of the hole, reflections from discontinuities in borehole casing, and reflections from true mud density changes caused by fluid influx. Moreover, the technique of the '212 patent suffers from a practicality viewpoint because it requires circulation through the choke.

In light of the above, a major object of the present invention is to provide a practical fluid influx system for an operating rotary drilling rig.

Another object of the invention is to provide a practical way during drilling to determine fluid influx into a borehole by comparing transit time to the surface via the annulus and with that of the drill string of an MWD communication mud pulse train.

Another object of the invention is to provide a practical way of determining fluid influx into a borehole while it is being drilled by comparing transit time to the surface via the annulus with that of the inside of the drill string of drilling noise generated by the interaction between the bit and the rock.

Another object of the invention is to provide a practical way of determining fluid influx into a borehole while it is being drilled from a standing wave analysis of the magnitude and phase of periodic acoustic signals caused by the mud pumps of the drilling rig.

Another object of the invention is to provide a practical way of determining fluid influx into a borehole while it is being drilled from the analysis of the total transit time of mud pump beats down the drill string and up in the annulus in the case where two or more mud pumps are being used.

Another object of the invention is to provide a practical way of determining fluid influx into a borehole while it is being drilled from the analysis of total transit time of mud pump(s) pressure waves down the drill string and up in the annulus.

Another object of the invention is to provide a practical way of determining fluid influx into a borehole while it is being drilled from the analysis of a frequency or Doppler shift of the acoustic signals generated by the mud pumps between a standpipe and annular transducer.

Another object of the invention is to simultaneously require a fluid influx determination (1) from a mud pump standing wave analysis (2) from a mud pump beat propagation analysis and (3) from a transit time analysis of an MWD communication mud pulse train or a downhole noise source associated with the interaction between the bit and the formation before a fluid influx alarm is provided to a driller.

Another object of the invention is to provide apparatus for informing a driller as to the location and size of a gas slug that has entered the borehole.

SUMMARY

Gas influx into a wellbore, which is commonly referred to as a "kick" by oil and gas well drilling specialists after it reaches the surface, is preferably detected by several related methods during active drilling of a well bore. These methods individually or collectively achieve the objects identified above and have other advantages and features. The methods are complementary in that one method relies on measuring acoustic energy through a gas slug while the other senses a reflection from a gas slug. Each method may be used independently to determine whether a fluid influx (usually gas) has occurred, but preferably the simultaneous detection of gas influx is required in order to generate an alarm for the driller. Both methods are preferably used in assessing the size and location of a detected fluid influx.

One method is based upon the existence of standing wave patterns generated by pressure oscillations of the drilling rig mud pumps. When measured in the annulus and normalized by standpipe readings, such standing wave patterns form sequences of maximum and minimum peaks and valleys with a time spacing between peaks (or valleys) equal to the time needed for the gas cut mud to be displaced over a distance equal to one-half wavelength of a standing wave of a frequency of the mud pumps. A method and apparatus are provided to determine that a gas influx has occurred by detecting the presence of such peaks above a predetermined magnitude, and a standing wave gas influx signal is produced. The time between such peaks, the elapsed time from the first peak above such predetermined magnitude, the gas cut mud slug upward velocity in the borehole, and the distance that such slug has travelled from the bottom of the borehole are all determined from such standing wave method and apparatus. The phase difference between the annulus and standpipe mud pumps signals is also an excellent gas indicator. In normal steady state operation, this phase difference is $k\pi$ where k is an integer, a well known property of standing waves. Should a gas influx occur, the propagation time between the standpipe and annulus increases which translates as an increasing phase difference between the two sensors. The more gas, the faster the phase difference increases. The rate of increase with time of this phase difference is therefore also used to estimate the quantity of influx gas.

Another method assesses the difference in arrival time of modulated pulse trains arriving at the surface in the annulus drilling mud and in the drill pipe drilling mud. Carrier pulse trains are phase or frequency modulated by a modulator/transmitter in the drill string near the bottom of the borehole. Down hole measured parameters in the form of digital words are used to modulate such carrier pulse trains. Differences in surface arrival times of such digital words greater than a predetermined magnitude are indicative of gas influx. A method and apparatus are provided to determine such arrival time difference and to use it as an indicator of gas influx. Such "delta arrival time" method is based on the fact that narrow band pass filtering of the received annulus and drill pipe signals converts such original phase or frequency modulation signals to amplitude modulation signals. The amplitude modulated signals are then converted to obtain frequency power spectra for each. A cross spectrum is then obtained and Inverse Fourier transformed back into the time domain to obtain a cross correlation function between the two amplitude modulation signals.

The abscissa of the maximum of such cross correlation function corresponds to the difference in arrival time of the annulus and drill pipe signals. Such function is determined in real time thereby producing a signal DT(t) of the real time delay between the received annulus and drill pipe signals. The amplitude of DT(t) is indicative of gas influx if it is greater than a predetermined maximum value. If the amplitude of DT is greater than such maximum value, a DT fluid influx signal is generated.

It is a good practice to normalize the cross correlation function with the geometric average of the signals spectra. The result is the cross correlation coefficient whose magnitude varies between −1 and +1. The magnitude of the cross correlation coefficient is an indicator of the quality of the correlation. Perfectly correlated traces have a correlation coefficient close to 1 whereas poorly correlated or noisy signals have a much lower correlation coefficient. This property serves as a rejection or validation criteria for the estimators of DT(t).

Some variance or scatter on the estimation of DT results from calculations performed on truncated time traces of finite bandwidth. This variance should be kept to a minimum so that it does not mask trends or variations of DT versus time that are related with gas entry in the wellbore. Classical techniques of overlapping along with the use of long time traces (typically 20 seconds) are used to diminish the variance. Another technique, specific to this application, is also implemented as follows: For each set of annulus and standpipe data blocks, different estimators of DT(t) are calculated, each corresponding to a slightly different value of the center frequency of the band-pass digital filter used to produce the amplitude modulation signals that are correlated to produce DT(t). For example, considering the case of a carrier frequency of 12 Hz, five estimators of DT are obtained with setting the band pass filter center frequency to 11, 11.5, 12, 12.5, and 13 Hz. These five estimators are then averaged together to produce an estimation of DT with less variance or scatter.

In a particularly preferred embodiment of the present invention, the DT determination kick signal and the standing wave kick signal are both required to be present before a kick indication alarm is given in order to minimize the chance of giving a falsealarm.

In yet another particularly preferred embodiment of the present invention, a third method can be used to back up the two previous ones in the case where two or more mud pumps are used in parallel. In this situation, it is common practice to operate the pumps at the same flowrate. Experience shows that this practice produces pressure beatings in the standpipe and that these beatings propagate down and up in the annulus. The beating frequency which is proportional to the difference in frequency of the two pumps is usually very low, for example 0.1 Hz. A phase difference of the beats between standpipe and annulus is a direct measurement of the sonic travel time T down the drill string and up in the annulus, and therefore of the presence of gas if an exponential increase of such travel time is detected.

The amount of gas of the detected gas influx is determined from a predetermined tabulated function of DT (difference in arrival time) or T Total transit time and the distance that a gas slug influx has travelled from the bottom of the borehole.

In the case where only one mud pump is being used, there are no low frequency beats and the assessment of the total transit time T is accomplished by measuring the phase shift which is subject to an ambiguity. Such ambiguity results because the phase shift is larger than the period of the waves and the measure of a phase angle is modulo $2\pi$. The total transit time T can be expressed as $$T=(n-\Phi/2\pi)/f$$

where $\Phi$ is the measured phase, f the frequency of the signal, and n an integer. The ambiguity comes from the fact that n is unknown. The integer n can be determined by imposing the physical fact that the total transit time T is independent of the frequency f. In other words, dT/df must be zero.

Practically, an initial value of n is guessed from considerations such as hole depth and mud weight. This value of n is then continuously checked especially when the frequency f varies, even slightly. If a variation of f produces a variation of T, then it means that the current value of n is not specified correctly, and n it is either incremented or decremented depending on the sign of dT/df until dT/df is zero or very small. For increased accuracy, the measurement is performed over several frequencies, namely the fundamental of the mud pump and as many harmonics as desired. Despite the continuous real time checking for the validity of the current value of n, it is possible that it may still be wrong. Therefore, instead of considering the total transit time T for energizing an alarm, it is a good practice to consider the rate o change of T with time, dT/dt, which is independent of n because n is a constant provided that the frequency f does not change with time t.

Another embodiment of the present invention includes apparatus and method to measure a frequency or Doppler shift between the standpipe and annular transducer. Such shift is produced when gas enters the borehole and changes the sonic propagation speed. This embodiment of the invention has the advantage of being unambiguous and therefore does not require computationally rich compensation algorithms as described above.

BRIEF DESCRIPTION OF THE DRAWINGS

The objects, advantages and features of the invention will become more apparent by reference to the drawings which are appended hereto and wherein like numerals indicate like elements and wherein an illustrative embodiment of the invention is shown, of which:

FIG. 1 illustrates processing steps for a second preferred embodiment of a phase method for estimating total transit time for mud pump noise to travel via the drill string to the bottom of the borehole and up the annulus. and FIGS. 13, 14A and 14B illustrate a Doppler shift method of analyzing standpipe and annulus signals resulting from mud pump acoustics to identify gas influx into the annulus while drilling.

DESCRIPTION OF THE INVENTION

Figure 1:
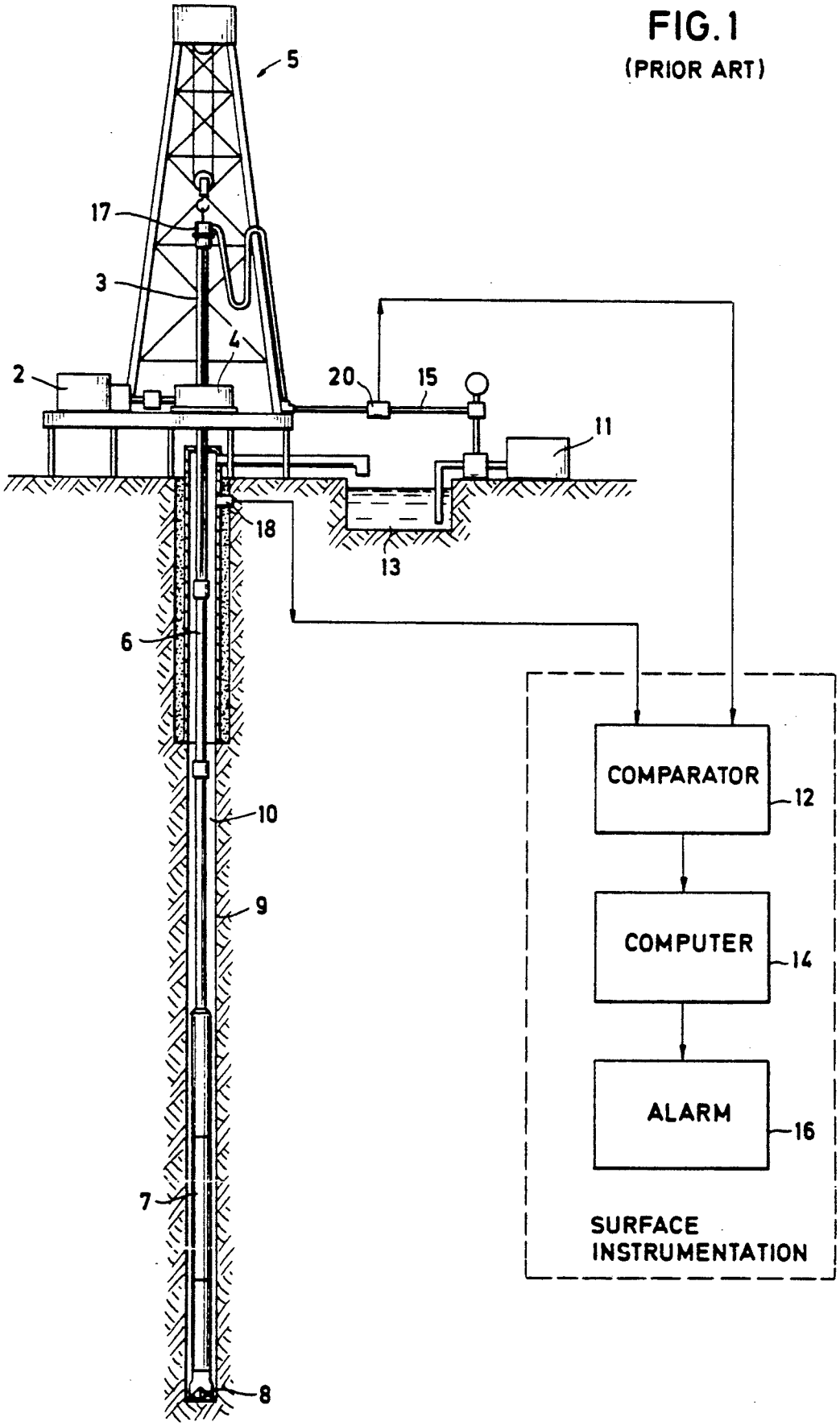
FIG. 1 (PRIOR ART)
FIG. 1 is a prior art system diagram for determining gas influx in a well bore while drilling by comparing annulus and drill string acoustic signals at the surface which are induced by a down hole mud pulse communication transmitter.

FIG. 1 illustrates a prior art rotary drilling rig system having apparatus for detecting a down hole influx of fluid (usually gas) into the annulus of the borehole. The rotary drilling system environment is familiar to those skilled in the art of oil and gas drilling. Briefly, the drilling rig 5 includes a motor 2 which turns a kelly 3 by means of a rotary table 4. A drill string 6 includes sections of drill pipe connected end to end and to the kelly and turned thereby. A plurality of drill collars and Measurement-While-Drilling (MWD) tools 7 are connected to the drill string 6 and are terminated by a rotary drill bit 8 which forms the borehole 9 as it is turned by the drill string.

Drilling fluid or "mud" is pumped by pump 11 from mud pit 13 via stand pipe 15 and revolving injector head 17 through the hollow center of kelly 3 and drill string 6 to the bit 8. The mud acts to lubricate drill bit 8 and to carry borehole cuttings upwardly to the surface via annulus 10 defined between the outside of drill string 6 and the borehole 9. The mud is delivered to mud pit 13 where it is separated of borehole cuttings and the like, degassed, and returned for application again to the drill string.

The drilling mud in the system not only serves as a bit lubricant and the means for carrying cuttings to the surface, but also provides the means for controlling fluid influx from formations through which the bit 8 is drilling. Control is established by the hydrostatic head pressure of the column of drilling fluid in annulus 10. If the hydrostatic head pressure is greater than the trapped gas pressure, for example, of a formation through which the drill bit 8 is passing, the gas in the formation is prevented from entering the annulus 10. Various agents may be added to the drilling mud to control its density and its capacity to establish a desired hydrostatic head pressure.

The mud column inside the drill string 6 also provides an acoustic transmission path for down hole measuring while drilling signals. The above-mentioned U.S. Pat. Nos. 4,733,233 and 4,733,232 illustrate that digital pulses of mud pressure may be established downhole near the bit 8 with MWD tools 7 and that such pulses may be detected and the information carried by them determined at the surface. These patents also suggest that a fluid influx into borehole 9 may be detected by providing a pressure transducer 18 at the surface to sense annulus pressure and pressure transducer 20 in stand pipe 15 to sense drill string pressure. These transducers compare the drill string and the annulus acoustic or pressure signals generated by the MWD communication transmitter located within MWD tool 7 near the bottom of the borehole. A gas influx in the annulus 10 affects certain characteristics of the annulus transmitted signal, but not the signal transmitted in the drill string 6. The patents teach providing a comparator 12 where the amplitude and/or phase of the annulus signal and drill string signal are compared. The patents indicate that a computer 14 may be used to assess the output of the comparator 12 so as to generate an alarm in circuit 16 if a fluid influx in detected.

Figure 2:
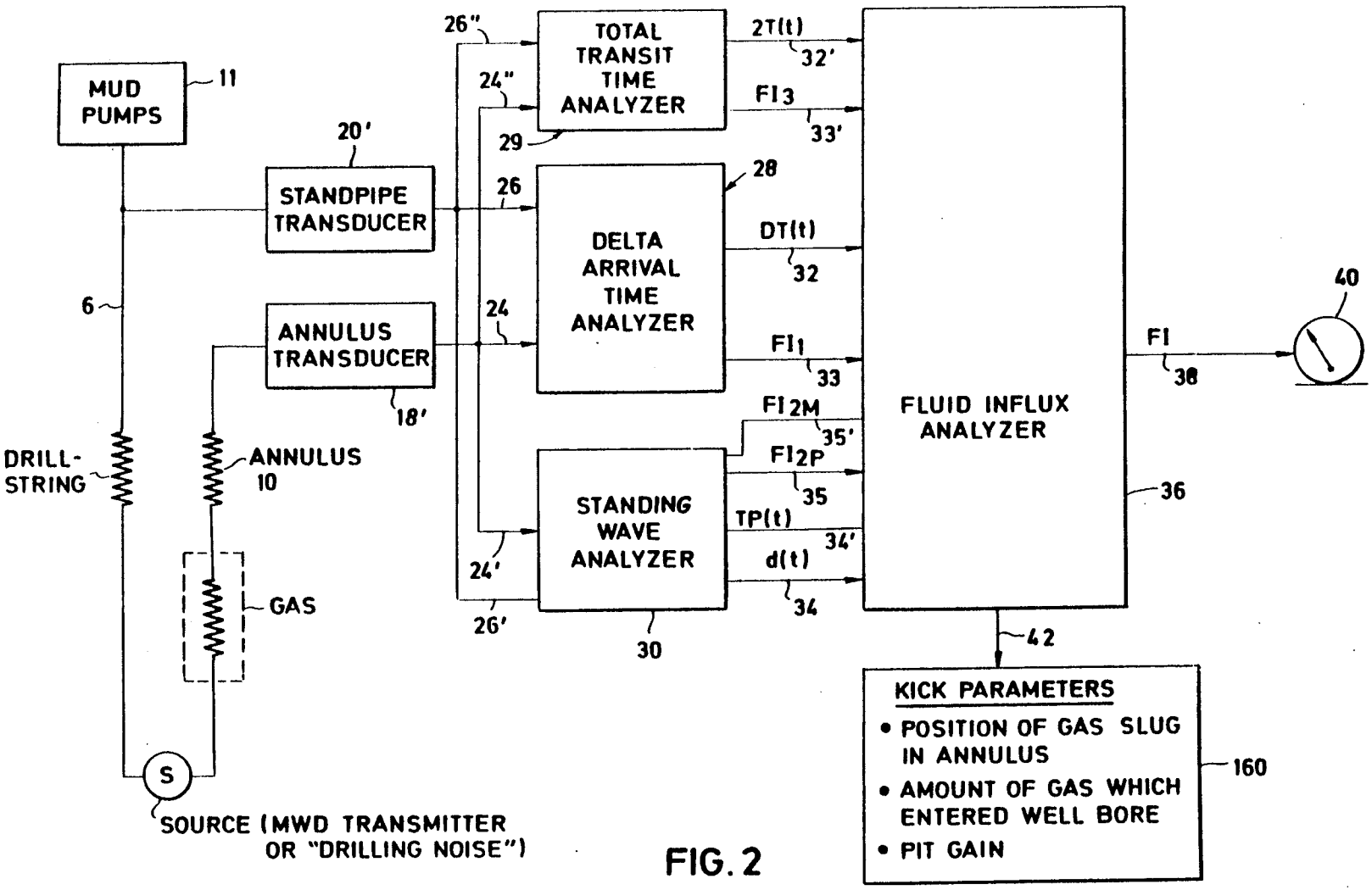
FIG. 2 is a system block diagram according to the invention where drill string and annulus signals are processed according to standing wave and difference in arrival time techniques as well as total transit time techniques to obtain independent fluid influx signals.

The present invention follows a somewhat related principle in that it likewise uses annulus and drill string pressure signals as a basis to detect a downhole fluid influx while drilling, but uses different signal sources and techniques to generate confirmatory fluid influx signals. FIG. 2 illustrates that an annulus transducer 18' and standpipe transducer 20' are disposed at the surface in a manner similar to that illustrated in FIG. 1. The drill string signal from standpipe transducer 20' and the annulus signal from annulus transducer 18' are applied to "Delta Arrival Time Analyzer" 28 via leads 26 and 24, respectively. The drill string and annulus signals are also applied to a standing wave analyzer 30 by means of leads 24' and 26', and to a total transit time analyzer 29 by means of leads 24" and 26". As used herein, the term "drill string pressure signal" or "standpipe pressure signal" or other variations thereof is intended to include those signals that are present in the drilling rig's mud circulation system anywhere between pump 11 and bit 8, which includes standpipe 15, kelly 3, and any other portions of the closed fluid circuit between pump 11 and bit 8. In practice, it has been found easiest to install transducer 20' on standpipe 15 to detect the drill string pressure signals, but it is to be understood that transducer 20' may be located anywhere between pump 11 and bit 8 in making this measurement. In contrast, the term "annulus pressure signal" or variations thereof is intended to include those signals that are present in the mud return side of the drilling rig's mud circulation system anywhere between bit 8 and mud pit 13 which is in fluid communication with annulus 10. In practice, it has been found that annulus transducer 18' is placed anywhere along this fluid circuit that is the easiest to gain access to.

The Delta Arrival Time Analyzer 28 generates a DT(t) signal on lead 32 representative of the difference in arrival time of a down hole source of sound via the annulus and via the drill string. This downhole source can, for example, either be an MWD signal transmitter or drilling noise generated at the bit and resulting from the interaction between the bit and the rock. In practice, the strongest of the downhole sources is preferably selected. Such signal is generated in real time t. If such DT(t) signal meets certain predetermined criteria, a Fluid Influx signal, called $FI_1$, is generated on lead 33.

The Standing Wave Analyzer 30 generates a d(t) signal on lead 34 representative of the distance a fluid influx or "gas slug" has moved from the bottom of the borehole toward the surface as a function of time t measured from the time the influx enters the borehole. It also generates on lead 34' an estimation of the variation of the total propagation time TP(t) down the standpipe and up the annulus. TP(t) is obtained from the phase curve versus time of the standpipe to annulus frequency response curve at the pump frequency. Also generated is an alarm $FI_2P$ on lead 35 and $FI_2M$ on lead 35'. This alarm is activated when the change in total propagation time TP(t) is positive.

The total transit time analyzer 29 generates on lead 32' a total transit time 2T(t) representing the transit time down the drill string and up the annulus determined from the pump beatings. In a preferred embodiment of the present invention, the total transit time analyzer 29 is used when two or more pumps are operating at roughly the same flowrate. An alarm $FI_3$ is generated on lead 33' when an exponential increase in 2T(t) is determined.

In the case where only one pump is used, then 2dT/dt, the rate of change versus time of the total transit time down the drill string and up the annulus, is used instead of the total transit time 2T itself. An alarm $FI_3$ is generated on lead 33' when 2dT/dt is larger than a predetermined threshold, for example, 12 milliseconds per minute.

The "Kick" or Fluid Influx Analyzer 36 responds to the $FI_1$ signal on lead 33, to the $FI_2$ signals on leads 35 and/or 35', and to the $FI_3$ signal (if one or more mud pumps are used as described below) on lead 33' to issue an alarm fluid influx signal FI on lead 38 for activating an alarm 40 at the driller's control station of the drilling rig 5. The Fluid Influx Analyzer 36 also preferably generates signals on lead 42 representative of the position of the gas slug in the annulus, the amount of gas or size of a gas slug which entered the well bore, and the pit gain as will be described hereinafter in greater detail. These signals may be used to provide real time information to the driller concerning a gas influx by means of a CRT display, a printer, plotter or the like positioned at a location convenient to the driller.

Delta Arrival Time Analyzer

Figure 3:
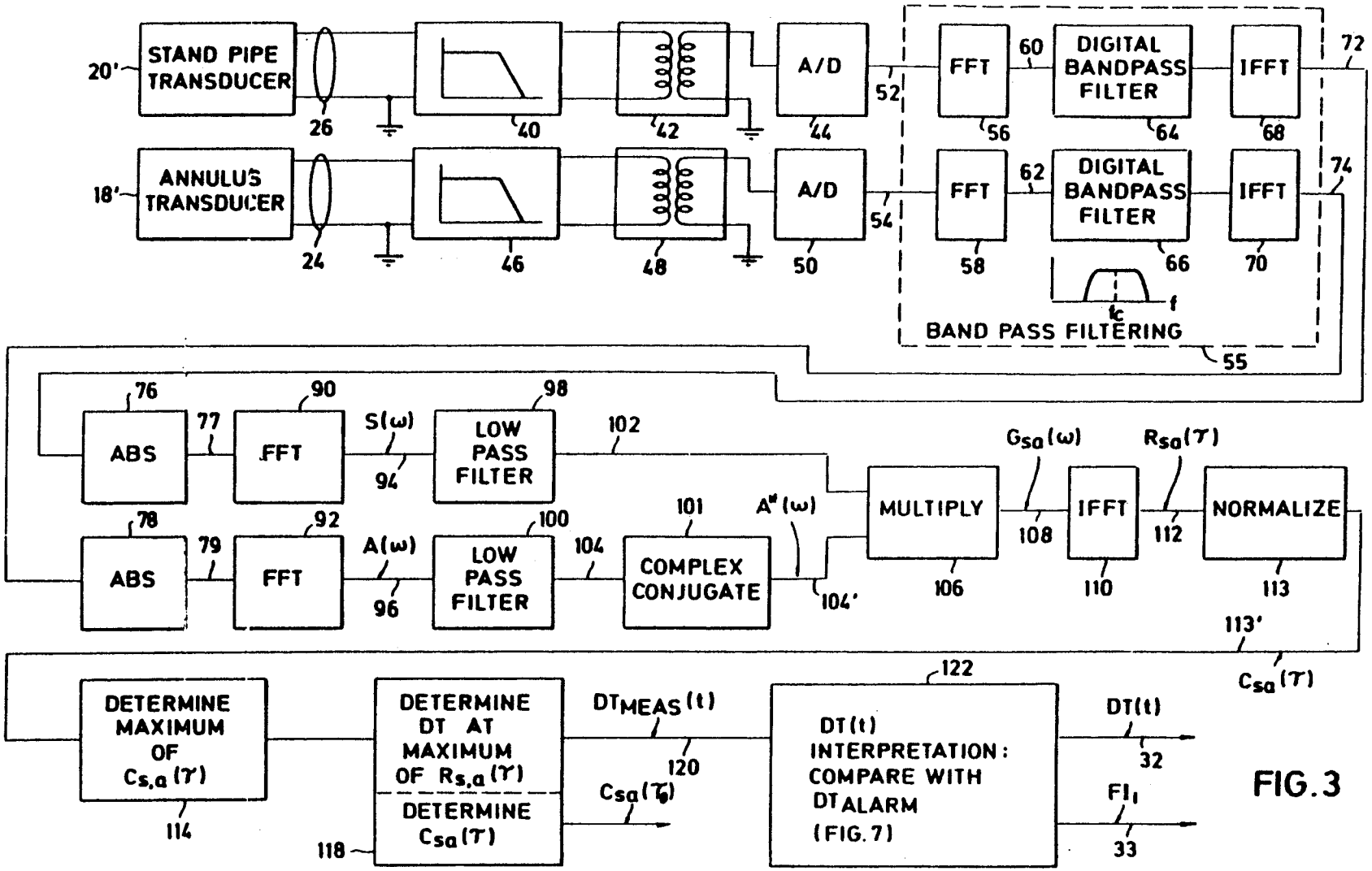
FIG. 3 is a block diagram illustrating the difference in arrival time method and apparatus for real time detection of a fluid influx in a borehole.

FIG. 3 illustrates the preferred hardware circuits and computer instrumentation to realize the Delta Arrival Time Analyzer 28 of FIG. 2. This circuit is used when the downhole source is a MWD telemetry modulator. The drill pipe pressure signal from standpipe transducer 20' is applied via leads 26 to a low pass anti-aliasing filter 40, a.c. coupling device 42, and an A/D circuit 44. The annulus pressure signal from annulus transducer 18' is likewise applied via leads 24 to a low pass filter 46, a.c. coupling device 48, and an A/D circuit 50. The drill string signal appears in digital form on lead 52; the annulus signal appears in digital form on lead 54.

Figures 6A, 6B, 6C:
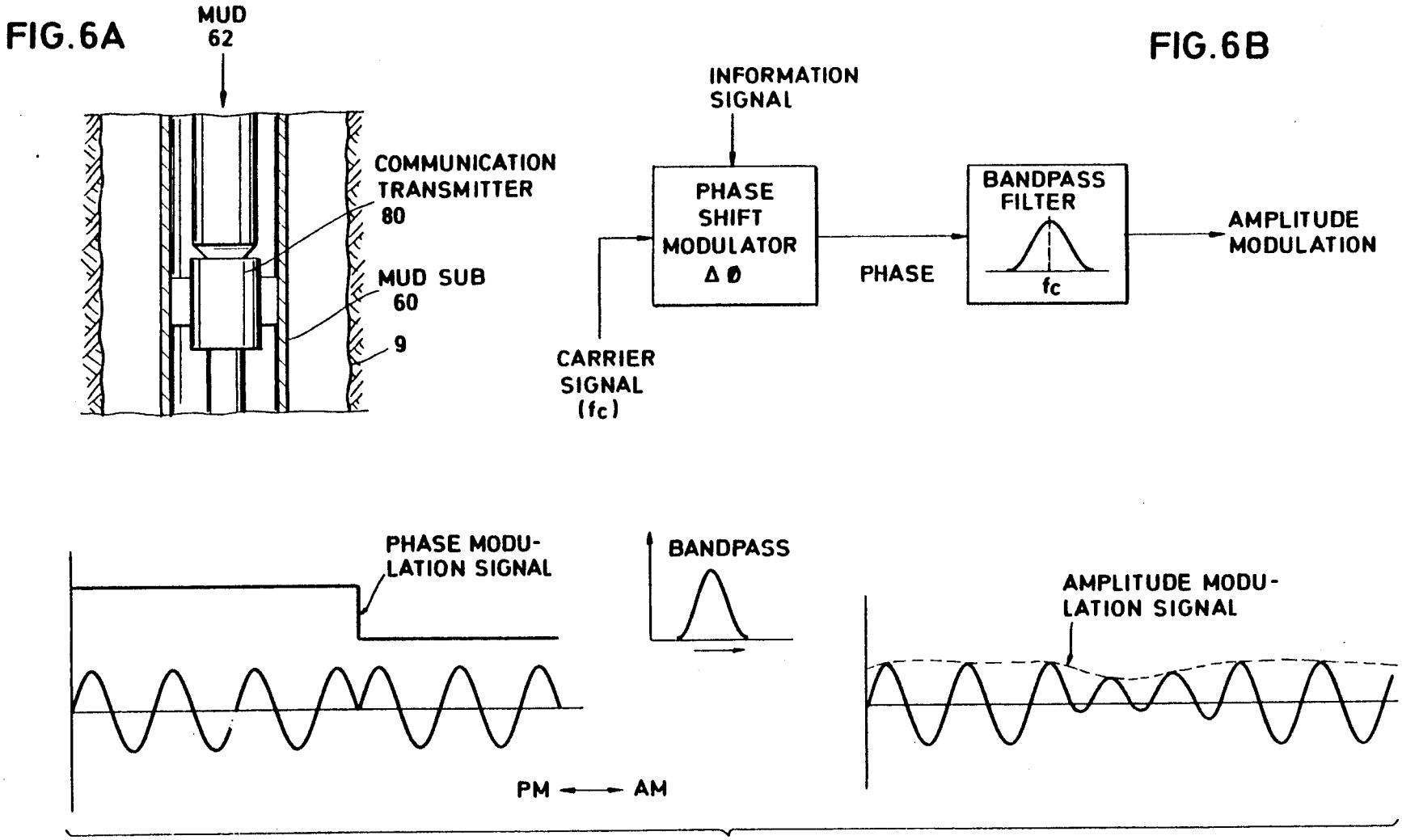
FIG. 6A illustrates a communication transmitter of an MWD system which produces a carrier signal of mud pressure pulses which are modulated by downhole measurements for transmission via the drill string mud path to the surface of the drilling rig or processing.
FIGS. 6B and 6C illustrate that an MWD carrier signal modulated in phase by a downhole information signal may be band pass filtered about the carrier frequency to produce a signal, the amplitude modulation of which is related to such information signal.

The signals appearing on leads 52 and 54 are representative of the mud pulse train created by a measuring while drilling communication transmitter located a short distance above the drilling bit in the borehole 9, e.g., transmitter 80 illustrated schematically in FIG. 6A as part of MWD sub 60. Such transmitter, described for example in U.S. Pat. Nos. 3,309,656 and 4,785,300 and incorporated by reference herein, produces a carrier train of pulses in the mud 62. The train of pulses is typically characterized by a center frequency $f_c$ representative of the pulse rate of the carrier. The pulse rate is modulated in accordance with measurement parameters measured down hole that are thereby transmitted to the surface.

The modulated signals are detected at the surface and demodulated so as to determine the information concerning measurements of downhole parameters. For purpose of the present invention, however, it is useful to determine the difference in arrival time to the surface of the modulated signal as it travels along one mud path via the interior of drill string 6, with the arrival time to the surface of the modulated signal as it travels along the alternative mud path via the drill bit and up to the surface via annulus 10. It is important to assess the arrival time of the same signal at the surface via these alternative paths, since the phase shift caused by a gas influx may be greater than 360°, making it difficult to compare the arrival time of two signals on the basis of phase differences.

Where the carrier pulse train is phase modulated, as illustrated schematically in FIG. 6B, there is an equivalence between the information of the amount of phase shift imposed on the carrier pulse train and the amplitude of such signals after they have been passed through a narrow band pass filter centered at the carrier frequency of the carrier pulse train. In other words, such filtering of a phase-modulated carrier pulse train converts the phase modulation to a signal the amplitude of which varies with the information signal imposed on or modulating the carrier pulse train. Such equivalence is also illustrated in FIG. 6C.

Accordingly, where the MWD transmitter includes a phase shift modulator of a carrier frequency as schematically illustrated in FIGS. 6A–6C, passing such signal through a band pass filter having a center frequency equal to that of the carrier frequency $f_c$ produces a signal the amplitude modulation of which replicates the information signal which modulated the downhole signal. Accordingly, and referring again to FIG. 3, the signals appearing on leads 52 and 54 are phase modulated pulse trains and are applied to digital band pass filters generally indicated as 55 in the following manner. Each time domain signal on leads 52 and 54 is applied respectively to a Fast Fourier Transform module 56, 58 to convert it to a frequency spectrum on leads 60, 62. Multiplication by the frequency response curve of band pass filters 64, 66 and Inverse Fast Fourier Transform modules 68, 70 convert the drill string and annulus signals to time domain signals on leads 72, 74. The amplitudes of these time domain signals vary with the down hole information used to modulate the carrier pulse train.

Next, the signals are applied to absolute value modules 76, 78, and then to Fast Fourier Transform modules 90, 92 via leads 77, 79. The output of FFT modules 90, 92 on leads 94, 96 are frequency spectra $S(\omega)$ and $A(\omega)$, the spectra for the drill string and the annulus signals as previously processed. The spectra are multiplied by the frequency response curve of low pass filters 98, 100 to produce the frequency representation of the envelope or amplitude modulation signal of the telemetry carrier on leads 102 and 104. The spectrum of the annulus channel is applied to a complex conjugation module 101 to produce an output $A^*(\omega)$ on lead 104'. The annulus complex conjugate spectrum $A^*(\omega)$ and standpipe spectrum $S(\omega)$ are then multiplied together in module 106 to produce the cross power spectrum $G_{SA}(\omega)$ of the drill string and annulus amplitude modulation signals. Such cross power spectrum on lead 108 is applied to Inverse Fast Fourier Transform module 110. The output of module IFFT 110 on lead 112 is the cross correlation function $R_{sa}(\tau)$ where $\tau$ is the lead or lag time between the drill string signal $s(\tau)$ and the annulus signal $a(\tau)$. Consequently, at each moment in real time t, the correlation function $R_{sa}(\tau)$ is produced.

The cross correlation function $R_{sa}(\tau)$ is then normalized by the geometric mean of the signal's power spectra in module 113 to produce the cross correlation coefficient $$C_{sa}(\tau) = R_{sa}(\tau)/\sqrt{(Rss(O)Raa(O))}\ .$$

Next, in module 114, the maximum of the cross correlation coefficient $C_{sa}(\tau_O)$ is determined and the lag or lead time $\tau_O$ at such maximum, defined as the difference in arrival time DT, is determined in module 118. The output of module 118 is applied on lead 120 as a real time signal DT(t). The value of correlation function $C_{sa}(\tau_O)$ is used as an indication of the quality of the measurement in the following exemplary way: if $C_{sa}(\tau_O)$ is larger than 0.9, then the measurement is valid; otherwise, the measurement is rejected and the previously calculated value of DT(t) is maintained on lead 120.

Figure 7:
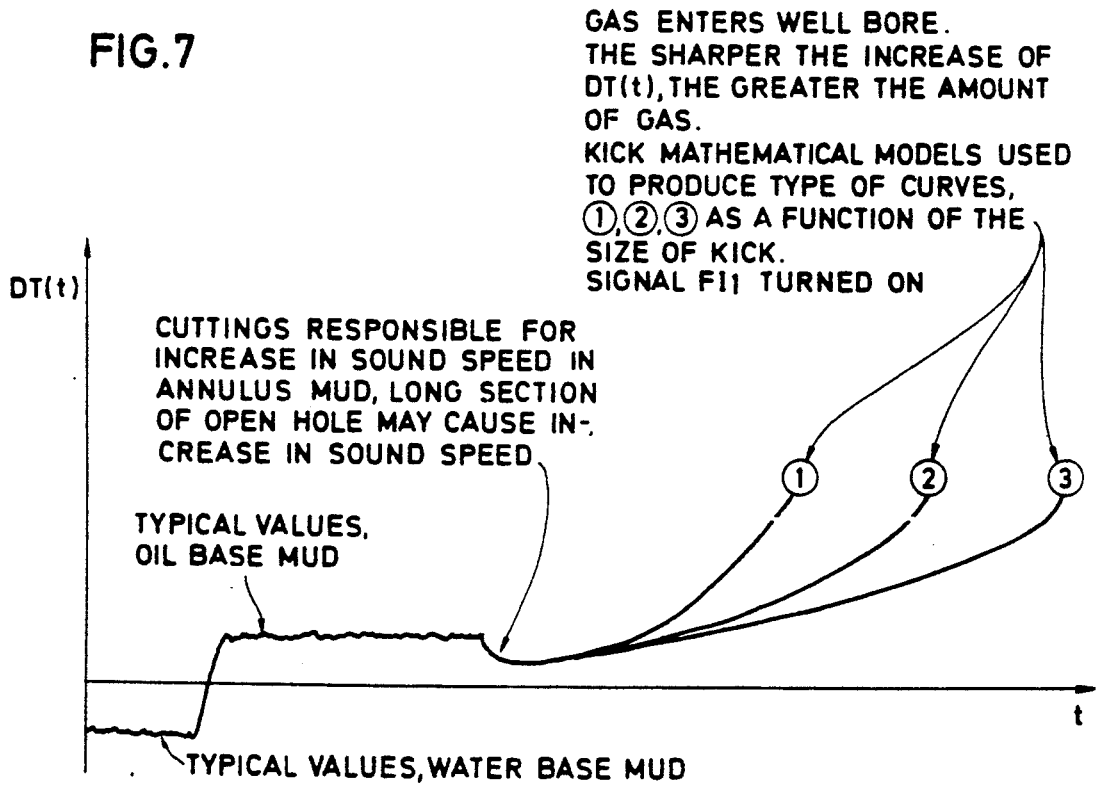
FIG. 7 illustrates DT(t) signals which are produced by the apparatus of FIG. 3 and indicates processing steps used to identify the magnitude of a gas influx in the difference in arrival time method and apparatus.

The time signal DT(t) is plotted versus time and interpreted as illustrated on FIG. 7. In normal drilling operations, DT(t) is almost a constant. The value of this constant is a function of the particular situation of the well being drilled, the location of the MWD transmitter within the bottom hole assembly (BHA), and the location of the surface receiving transducers. These parameters are normally constant during the drilling process.

The presence of cuttings in the annulus is responsible for an increase in annulus acoustic speed and therefore for negative values or trends of DT(t) toward lower values. Sound speed is increased due to cuttings, because cuttings increase the bulk modulus of the mud.

When using oil base mud, the average speed of sound over the entire length of the annulus is generally lower than the average speed of sound in the drill string. The reason for this phenomenon is the presence of dissolved gas in the mud, which is more likely to come out of solution in the annulus since the annulus pressure is less than the pressure inside the drill string. Because sound speed is lower in gas cut mud, pressure pulses take a longer time to travel up the annulus and thus the larger value of the delay DT(t).

The influx of formation gas into the wellbore is characterized by an exponential increase of DT versus t. This behavior has been observed experimentally and mathematical models predict these effects. Use of these models provides curves that each correspond to a different size kick. Referring to FIG. 7, curve (3) corresponds to a 1 barrel kick; curve (2) to a 3 barrel kick; and the curve 1 to a 10 barrel kick. Determining the similarity between tabulated curves and measured curves can be performed in real time using, for instance, least square criteria or by minimizing a previously defined distance between the type of curves and the measured curves. When a similarity between the measured DT(t) curve and type curves stored in the memory of a computer is established, then a fluid influx signal $FI_1$ is output on leads 32, 33 as illustrated in FIG. 2.

It is well known that under certain circumstances, wide frequency band noise can be generated downhole in connection with the interaction between the bit and the rock. This noise propagates up in the annulus as well as in the drill string and its magnitude, especially in the annulus, can be several times larger than the magnitude of the pressure pulses associated with MWD telemetry. When such a situation occurs, the delta arrival time method described above is subject to failure because of poor signal to noise ratio. Nevertheless, it has been discovered that it is possible to continue the same general type of measurement and analysis by using the drilling noise as a sound or mud pressure source instead of the MWD transmitter. However, due to the nature of drilling noise, the processing of the signals is different, although the result is still the same: there is a difference in transit time of pressure waves propagating inside the drill string and in the annulus.

Figure 8:
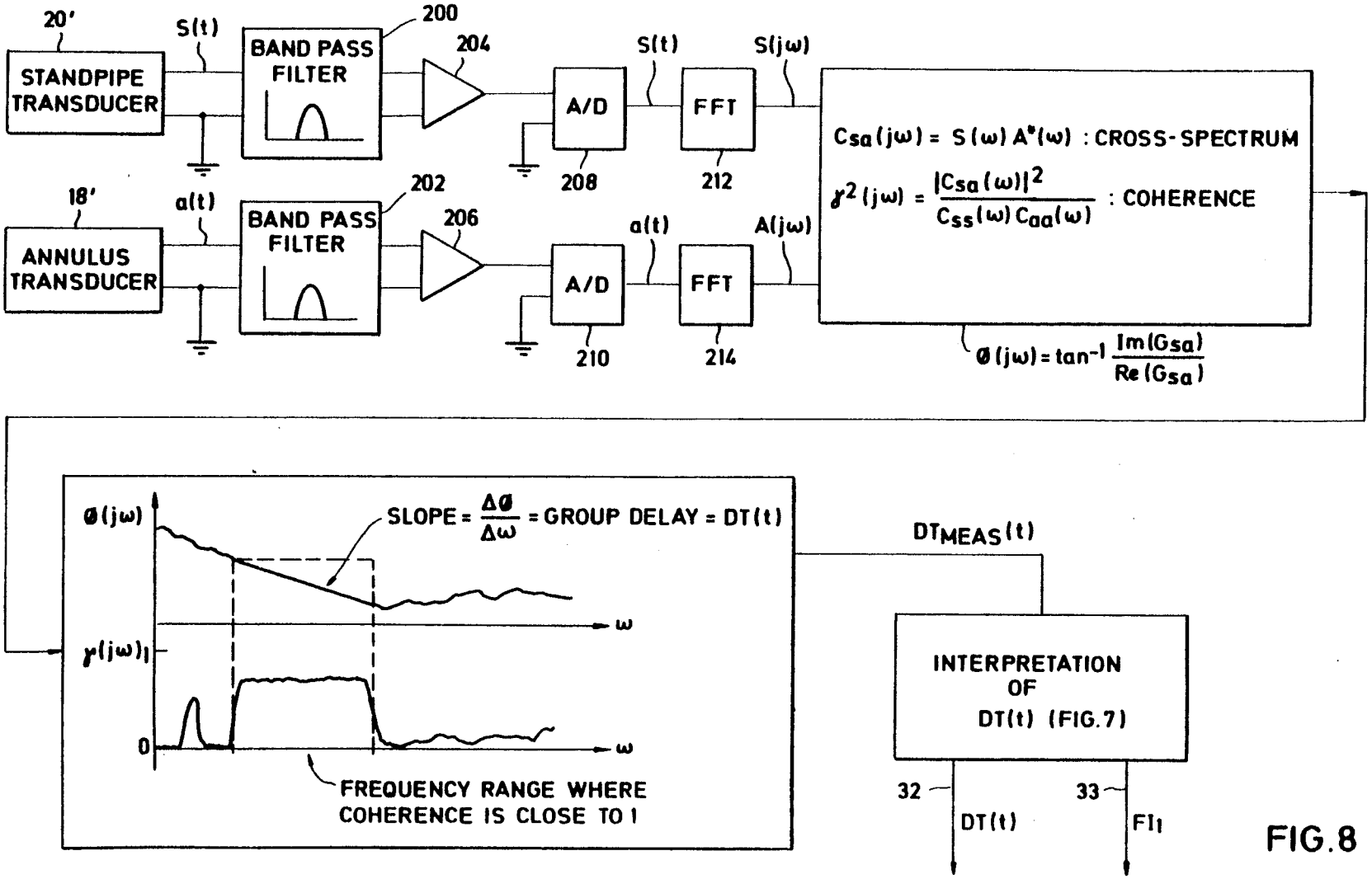
FIG. 8 illustrates instrumentation of the difference in arrival time method and apparatus where the downhole signal source is drilling noise.

The signal processing in this latter case is preferably performed according to the schematic presented in FIG. 8. Prior to analog to digital conversion, the annulus and standpipe signals are band pass filtered by filters 200, 202. The lower end cut-off frequency is adjusted in such a way that mud pump or telemetry signals are rejected. Practically, this cut off frequency has been found to be around 24 Hz. The high pass cut-off frequency serves anti-aliasing purposes. In practice, it is preferably set at approximately 400 Hz. After the band pass filters, the signals are amplified by instrumentation amplifiers 204, 206 in order to take full advantage of the A/D dynamic input range. After the conversion to digital form by A/D converters 208, 210, the standpipe signal S(t) and the annulus signal a(t) are Fourier transformed in FFT modules 212, 214 to produce respectively the spectra $S(\omega)$ and $A(\omega)$. The next step is to determine the cross spectrum $C_{sa}(\omega)=S(\omega)A^*(\omega)$ and the coherence $\text{Gamma}^2=|C_{sa}(\omega)|^2/C_{ss}(\omega)C_{aa}(\omega)$ where $C_{ss}(\omega)=S(\omega)S^*(\omega)$ and $C_{aa}(\omega)=A(\omega)A^*(\omega)$ denote respectively the standpipe and annulus power spectra, and where * indicates complex conjugation. Coherence is an indication of the statistical validity of the cross spectrum measurement. The next step is to calculate the phase of the cross spectrum as a function of frequency. This phase $\phi(\omega)$ is calculated as the inverse tangent of the ratio of the imaginary part to the real part of the cross spectrum. The group delay, which is the final goal of these calculations, is the negative slope $-d\phi/dw$. It is calculated over a frequency band where the coherence is close to 1. This process is illustrated in FIG. 8. The value of $DT(t)=\tau_O$ is equal to $-d\phi/dw$. The interpretation performed on DT(t) is the same as when DT(t) was calculated with the MWD transmitter as a source as explained in detail earlier herein.

If desired, the fluid influx signal $FI_1$, on lead 33 (FIG. 2) could be used to sound an alarm by means of a bell or the like at the driller's control station, but i simultaneously determine fluid influx from one or more independent methods. One such independent method is based on monitoring and analyzing standing waves due to the drilling rig mud pumps.

Standing Wave Analyzer

Figures 4A, 4B:
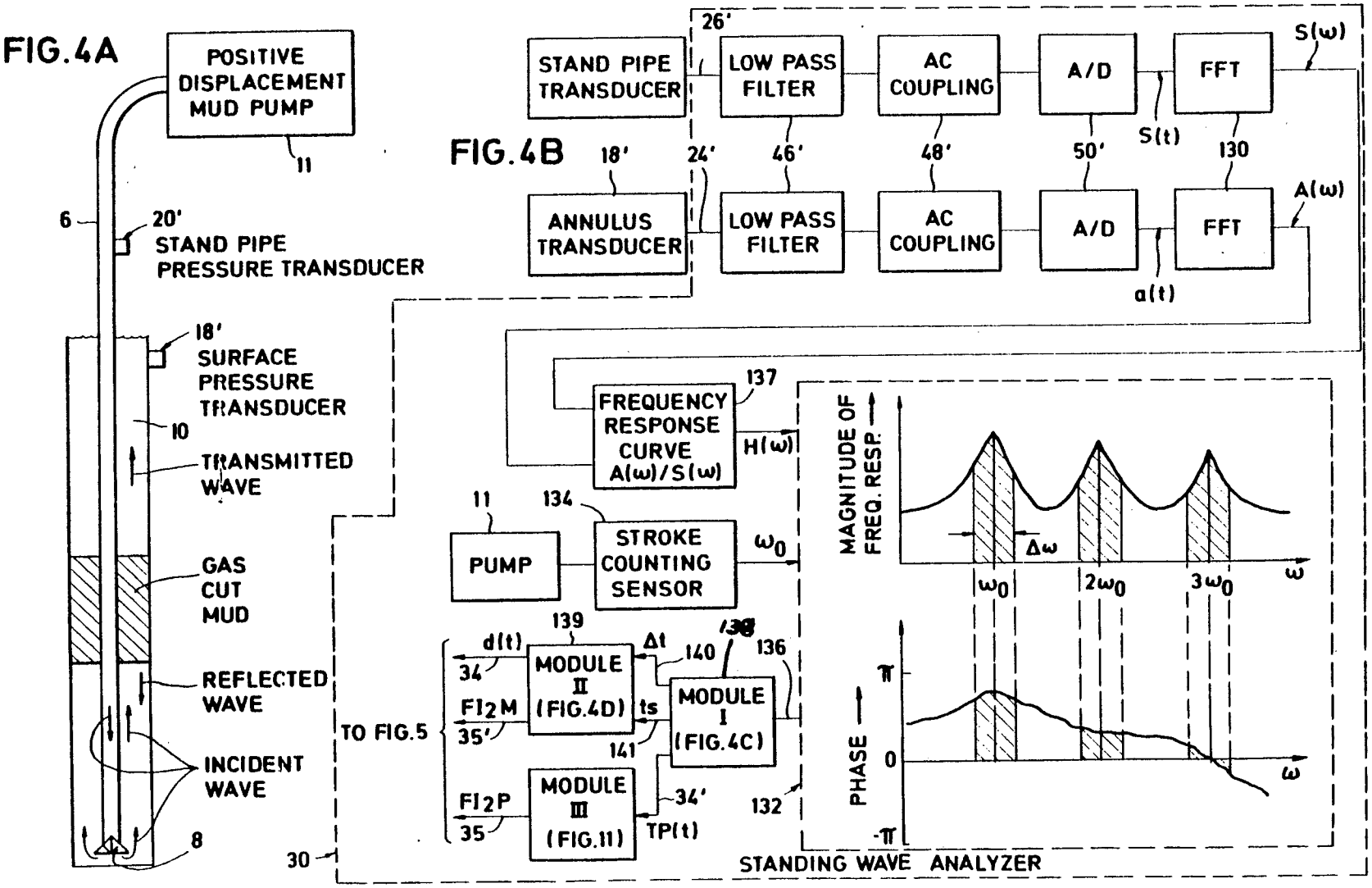
FIG. 4A illustrates how mud-pump induced standing waves are altered by gas influx into the annulus of a borehole.
FIG. 4B illustrates the determination of the standpipe to annulus frequency response curve which is carried out at frequencies corresponding to the mud pumps fundamental and two first harmonics.

FIG. 4A generally illustrates how a gas influx into the annulus 10 of the borehole affects standing waves in the annulus set up by the vibration or noise of mud pumps 11. The vibration waves propagate down drill string 6, out the drill bit 8, and upwardly toward the surface via the annulus 10. If a gas slug enters the well and creates a section of gas ct mud as shown, such vibration waves are partially reflected from the bottom of the slug and, as a consequence, the standing wave pattern is altered. Part of such waves is transmitted to the surface via annulus 10 where it is sensed by annulus transducer 18'.

FIG. 4B illustrates the standing wave signal processing according to a preferred embodiment of the present invention. The annulus pressure signal detected by annulus transducer 18' on lead 24' is applied to low pass filter 46', to a.c. coupling circuit 48', and then to A/D circuit 50'. The standpipe pressure signal detected by stand pipe transducer 20' on lead 24' is applied to a similar low pass filter 46', to a similar a.c. coupling circuit 48', and then to A/D circuit 50'. The conditioned signals a(t) and s(t) for annulus and standpipe, respectively, are then transformed into the frequency domain by means of FFT modules 130 to produce signals $A(\omega)$ and $S(\omega)$ which are then transmitted to a frequency response curve calculation module 137. The frequency response curve $H(\omega)=A(\omega)/S(\omega)$ is the ratio of the cross spectrum $S^*(\omega)A(\omega)$ to the input power spectrum $S^*(\omega)S(\omega)$, where * indicates complex conjugation. The magnitude and phase of $H(\omega)$ are then averaged over a frequency band of width Delta $\omega(\Delta\omega)$ centered on $\omega_o$, the pump fundamental frequency. The same averaging is subsequently performed for the first and second harmonics $2\omega_o$ and $3\omega_o$. The results are denoted by $S\omega i$ for the magnitude and $\phi i$ for the phase where the subscript i is 0 for the fundamental and 1, 2, . . . for the harmonics 1, 2, . . . .

Simpler and less computing power consuming methods well known to those skilled in the art of signal processing can be used. For example, since the frequency response curve for certain values of the frequency is needed, it is not necessary to perform a complete Fourier Transform of the signals. Sine and cosine transforms at the frequencies of interest will generally suffice. However, with the Delta Arrival Time Analyzer 28 available as illustrated in FIGS. 2 and 3, the Fourier transforms of the standpipe and annulus traces are already available and therefore might just as well be used.

The angular frequencies $\omega_i$ correspond to the mud pump fundamental frequency and to its harmonics. This information is obtained independently from another sensor, usually a stroke counting sensor 134 (FIG. 4B) mounted on one piston of the pump 11. Should two pumps be used, then the analysis is performed on 4 frequency bands, i.e., the two fundamentals and the two first harmonics of the two pumps.

Referring again to FIG. 4B, the bandwidth Delta $\omega(\Delta\omega)$ is adjusted to obtain the best compromise between scatter of the results (this requires large Delta $\omega$) and meaningfulness of the result (low values of Delta $\omega$) because $S\omega 0$ and $S\omega 1$ must be representative of the magnitude of the acoustic pressure within the frequency band of the mud pumps. Typical values of Delta $\omega$ are in the range between 0.005 and 0.05 Hz.

The next step is to plot $S\omega i$ and $\phi i$ (and their equivalents if a second mud pump is used) versus time as drilling progresses. The curves illustrated in FIG. 4C are typical of what is obtained.

Magnitude Analysis of Standing Waves

The $S\omega i$ curves are characterized primarily by oscillations with a periodicity equal to the time necessary to drill a length of hole whose length is equal to one-half wave length at the considered frequency $\omega_i$. These periodic peaks are related to resonances of the system constituted by the drill string inside a borehole of finite length. For instance, at a rate of penetration of 100 feet per hour, the time to drill one half wavelength is 8 hours. It is apparent that the periodicity on the plot of $S\omega 1$ is one half that of $S\omega 0$ because the frequency corresponding to $S\omega o$ is half the frequency corresponding to $S\omega_1$. If an influx occurs at time $t_s$, then the periodicity in the plots of $S\omega i$ is increased by a great amount because now it corresponds to the time needed for the boundary of the gas cut slug of mud to move upward over a distance equal to one half wavelength, and that the rise velocity of the slug is much larger compared to the rate of penetration.

Figure 4C:
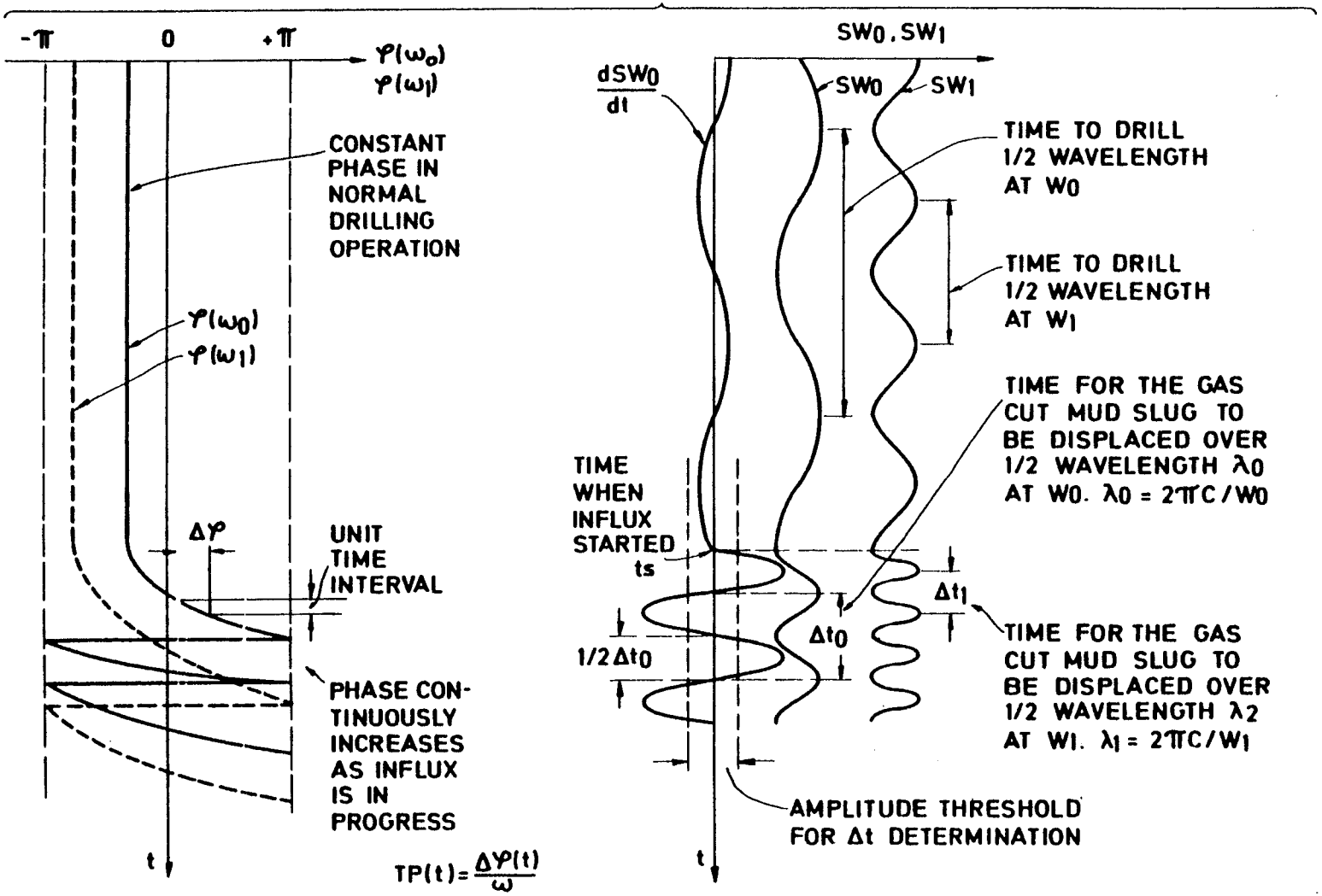
FIG. 4C illustrates the time variation of the magnitude and phase of the frequency response curve determined as indicated in FIG. 4B and indicates the effect on such signals when a gas influx enters the annulus of the borehole.

Module I 138 (FIG. 4B) in response to the $S\omega 0$, $S\omega 1$ signals on lead 136 determines the time Delta t between peaks of oscillations of $S\omega 0$ or $S\omega 1$ according to the steps outlined in FIG. 4C.

The measurement of Delta t, the time for the slug to be displaced over ½ wavelength, is complicated by the fact that oscillations of the plot of $S\omega i$ are not only due to the slug effect. As discussed above, the drilling process as it progresses is also responsible for oscillations in $S\omega i$. Therefore, a determination of Delta t on the sole basis of the distance between consecutive peaks or valleys is not entirely suitable.

The discrimination is made on the basis of how steep the peaks are and from a practical viewpoint, the method used for determining the time intervals Delta t between oscillations is based on analyzing the derivative versus time of the $S\omega i$ traces. One-half Delta t is the time between zero crossings of $dS\omega i/dt$. Only those zero crossings where $|dS\omega i/dt|$ is larger than a predetermined threshold are considered. This is equivalent to setting a threshold on how steep the peaks are.

Of great importance also is the determination of the time $t_s$, the time when the influx started. Time $t_s$ is determined as the first zero crossing of the derivative of $S\omega o$ versus time that satisfies the threshold criteria on the absolute value larger than a predetermined threshold. The practical determination of the threshold can be made by setting this threshold to 150% of the average value of the magnitude of the derivative of Sωo versus time measured over a time interval where there is no influx, for instance at the beginning of drilling when the hole depth is shallow.

After two peaks or more are measured and a time Delta t determined between them, a Delta t signal is applied from module 138 to Module II 139 of FIG. 4B (Module 142 of FIG. 4D) via lead 140 and a $t_s$ signal is applied to module 146 (FIG. 4D) via lead 141.

Figure 4D:
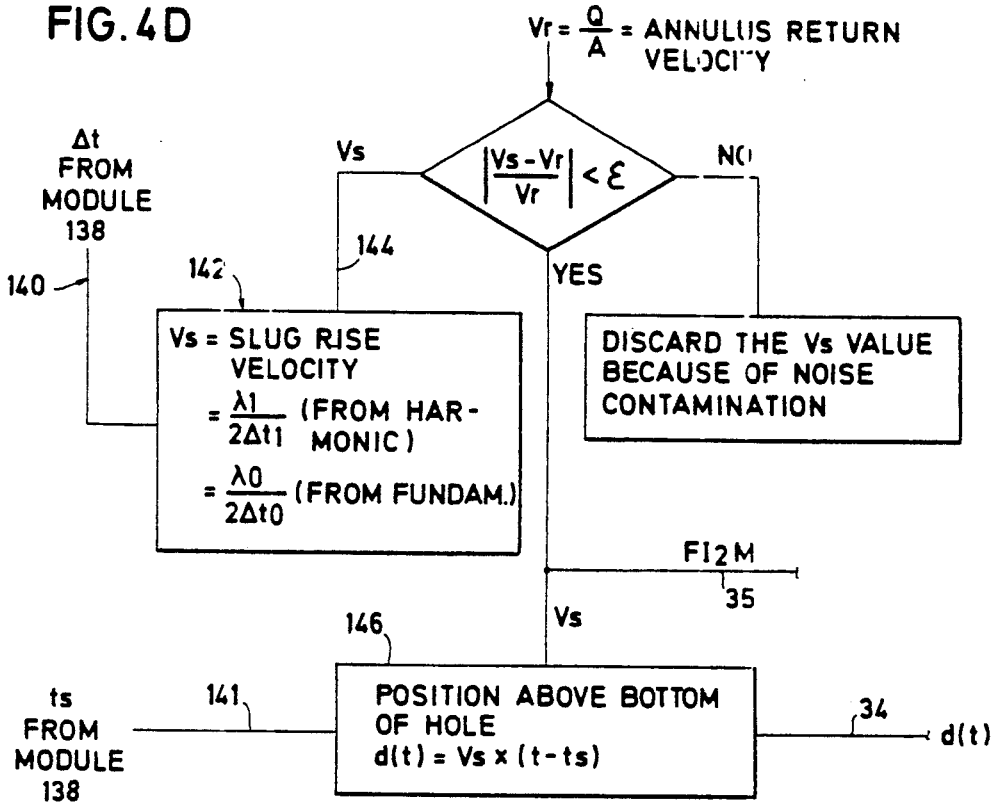
FIG. 4D illustrates how slug rise velocity is determined and its use in determining the distance from the bottom of the borehole that the gas slug has traveled.

Module 142 of FIG. 4D accepts the measurement signal Delta t on lead 140 and divides the predetermined one-half wavelength lambda (½λ) by the signal Delta t to determine a gas slug velocity signal on lead 144. The calculation of the slug rise velocity $v_s$ is primarily based on the ½ wavelength λ and Delta t corresponding to the mud pump fundamental, i.e. ½ $lambda_0$ and Delta $t_0$. Another estimate of $v_s$ can be obtained using the ½ wavelength $lambda_1$ and Delta $t_1$ corresponding to the first harmonic. The next step is a consistency check.

The consistency check uses the mud flow rate Q and the annulus cross section area A known from hole size and drill bit size. The mud return velocity $v_r=Q/A$ is determined. Next, $v_s$ and $v_r$ are compared, which can be implemented practically by calculating $|v_s-v_r|/v_r$ and comparing this to a predetermined ratio. For example the value for can be set to 0.3. Two cases are considered:

i) If $|v_s-v_r|/v_r>\epsilon$, the consistency check test fails. The measured value of $v_s$ is meaningless and should be discarded. This typically occurs in the case of poor signal to noise ratio or in connection with an event that is unrelated to gas entry into the wellbore.

ii) If $|v_s-v_r|/v_r<\epsilon$, the consistency check test succeeds A fluid influx alarm $FI_2M$ is output on lead 35' (see also FIG. 2) and $v_s$ can be used to determine the position of the gas slug at time t. This is performed in module 146. The position above the bottom of the hole d(t) is given by $d(t)=v_s(t-ts)$ and output on lead 34. The $t_s$ signal determined in module 138 as explained above is connected to module 146 via lead 141.

Phase Analysis of Standing Waves

1. First Preferred Embodiment

Figure 11:
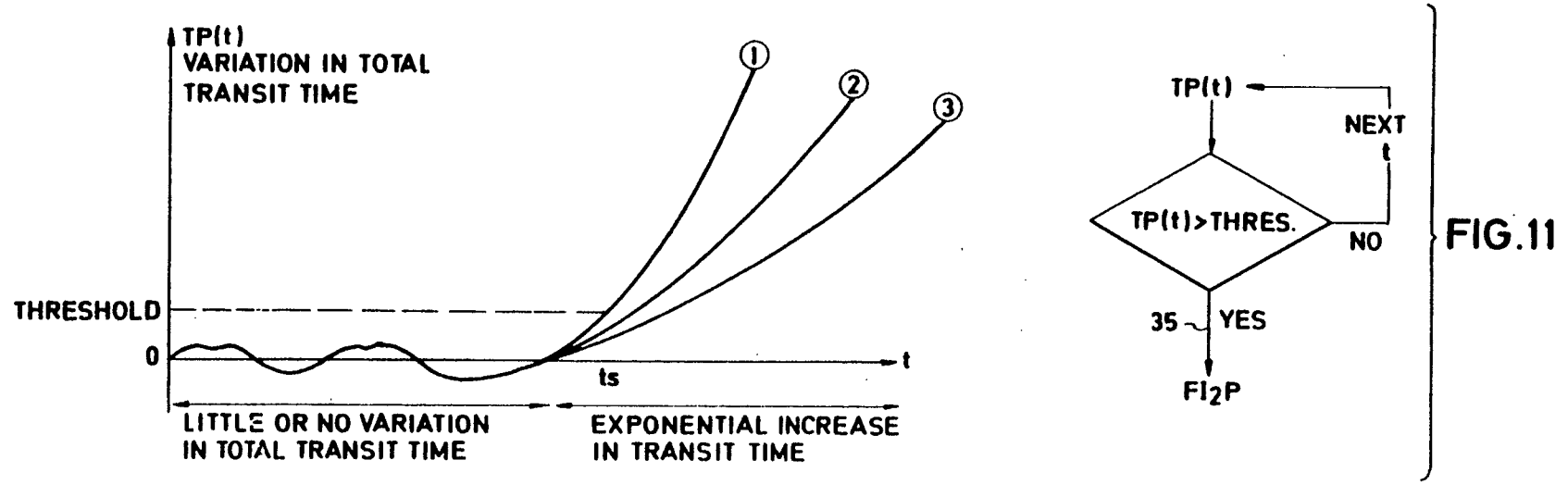
FIG. 11 illustrates additional processing steps used to identify gas influx.

The left hand side of FIG. 4C illustrates plots of phase $\phi i(t)$ (for i=o and i=1) versus time t. In the normal drilling mode, the value of $\phi i(t)$ is in theory equal to $k\pi$ with k being an integer, which is a well known property of standing waves. In practice, $\phi i(t)$ is equal to some constant different from $k\pi$, because additional phase shift between stand pipe and annulus is introduced by the amplifiers of the sensors as well as the AC coupling and anti-aliasing filters which are not absolutely identical. At the time $t_s$, when gas is entering the wellbore, the phase $\phi i(t)$ starts increasing, because the standpipe to annulus propagation time increases. Since phases are measured modulo $2\pi$, the only possible values are between $-\pi$ and $+\pi$. Thus, every time increasing $\phi i(t)$ reaches $+\pi$, it is reset to $-\pi$ and continues to increase from there. The resulting visual effect is a "rolling" of $\phi i(t)$. The larger the influx, the faster the rolling. This is assessed by measuring Delta $\phi(t)$, the amount $\phi i(t)$ has increased during an arbitrary unit time interval. The next step is to calculate the variation in total transit time TP(t)=Delta $\phi(t)/\omega$ and to plot it against time t as indicated in FIG. 11. Whenever an influx takes place, TP(t) exceeds a predetermined threshold and exhibits an exponential behavior. Different size kicks produce the curves labeled 1, 2, 3, in order of decreasing size of the kick. A kick mathematical model is used to produce type curves 1, 2, 3. An alarm $FI_2P$ (P stands for phase) is output to the fluid influx analyzer 36 on lead 35 whenever TP(t) exceeds the threshold.

2. Second Preferred Embodiment a. General description

A second preferred mode of taking advantage of the phase curves is to eliminate the 360 degree ambiguity by requiring that the measurement of total transit time of T be independent of the frequency. The correct expression for the total transit time T is:

$$T=(n-\phi/2\pi)/f,$$

where n is an integer and f is the frequency. The initial value of n is estimated (that is, guessed at) from the theoretical transit time calculated from the depth and the mud weight that controls the speed of sound. The value of n is then continuously checked by requiring that dT/df be minimum. Different estimates of T are obtained for different frequencies, namely the fundamental and as many harmonics as desired. The results are then averaged together to produce a single output. A weighted average is preferred, the weights being the signal strength Sωi and the coherence at the considered frequency.

In order to eliminate erratic and meaningless data likely to generate false alarms, certain estimates of T are not incorporated in the averaging process. Preferably, only those measurement points satisfying the following conditions are incorporated in the averaging process:

1) The value of Sωi must be larger than a predetermined threshold This requirement eliminates data taken when the pumps are not running.
2) The width of the frequency peak should not exceed a predetermined value. This requirement enables discrimination between mud pump(s) signals and unwanted downhole mud motor noise.
3) The coherence of the current measurement should be in excess of a threshold value, e.g. 0.90.
4) The coherence of a predetermined number of prior measurements should be larger than 0.90. The number of predetermined prior measurements should typically be of the order of 3 to 4.
5) The frequency of the peak must be stable. Data with a relative frequency change compared with the prior measurement exceeding a certain percentage are rejected. This percentage can be of the order of 4 to 10%.

In order to increase the reliability of the measurement, it may be preferable to consider the rate of change of the total transit time T versus time, dT/dt, rather than T for the alarm indication.

b. Particular description

As discussed above, sonic waves generated by the mud pumps propagate down the drill string, exit through the bit nozzles, and return to the surface via the annulus. The total transit or propagation time T is a function of borehole depth, mud weight, hole characteristics, and the presence of gas in the mud. However, the rate of change of T is primarily affected by the presence of gas since other factors (depth, mud, weight, etc.) vary slowly in time as compared with the change caused by an influx of gas in the mud (that is, the void fraction).

As illustrated in FIGS. 4A and 4B, a phase difference $\Phi$ exists between the signal of a transducer located on the standpipe (e.g. 20 of FIG. 4A) and of a pressure transducer located for example, on the bell nipple to measure annulus pressure. Such transducers are illustrated in FIG. 4B as annulus transducer 18' and standpipe transducer 20'. The measurement is performed at selected frequencies $f_i$ for $i=0, \ldots N$. N is preferably set at 6. In other words, the phase measurement is performed for the fundamental frequency and the five first harmonics.

The following relationship exists between the total transit time $2T_i$ of the i th harmonic, the phase $\Phi_i$ of its harmonic, and the frequency $f_i$ of the i th harmonic:

$$2T_i=(n_i-\Phi_i)/2\pi/f_i$$

where $n_i$ is an integer.

The initial value of $n_i$ is estimated from the depth and mud weight values at the time the method is started. For example, $n_i$ is the integer part of 2 x borehole depth-/sound speed, where the sound speed is $\sqrt{25\times10^8/p}$, where p is the mud weight in SI units.

The $n_i$ integers are subsequently incremented when the phase values $\Phi_i$ reach $-\pi$. The current values of the $n_i$ are continuously checked by requiring that $d2T_i/df_i$ be a minimum. Differences between consecutive values of $2T_i$ are then averaged together in order to produce a synthetic parameter, which when compared to a threshold number, can generate a gas influx alarm signal. Rather than use a simple average, a weighted average is used. The coherence and signal strength are the weighting parameters.

Figure 12:
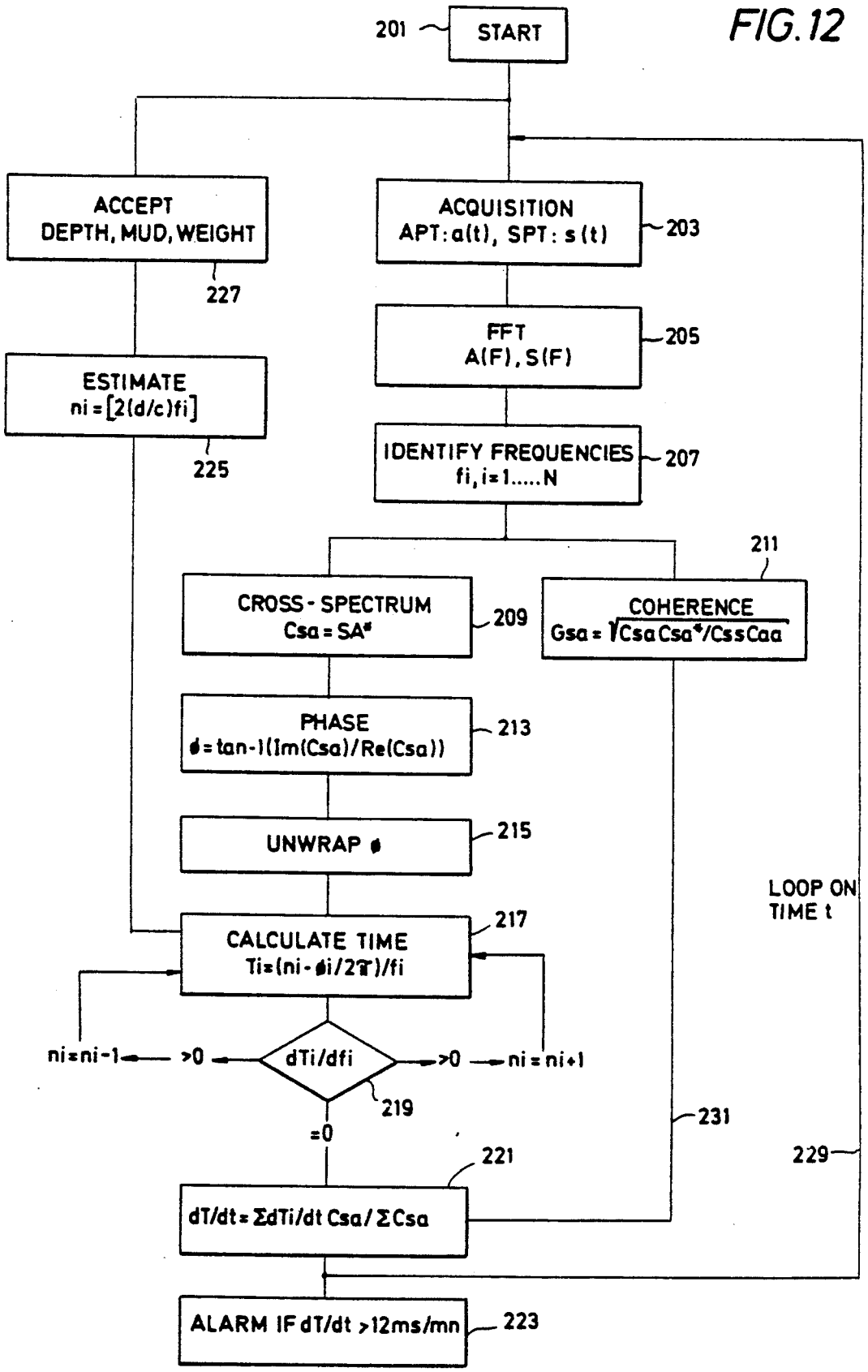

FIG. 12 is a block diagram of the computer program used to implement the method outlined above. The start logic box 201 signifies that the method begins under control of a digital computer. The logic box 203 indicates that time traces for the annulus signal a(t) and the standpipe signal s(t) at the present time are acquired and stored for processing.

Logic box 205 indicates that the annulus signal a(t) and standpipe signal s(t) are translated to the frequency domain by Fast Fourier Transform techniques to produce corresponding frequency domain functions A(F) and S(F). Preferably, a cosine taper window is first applied to each time signal. Next, the fourier transform is accomplished not by performing two real FFT's, but preferably by determining the FFT of the real part of the standpipe signal plus the imaginary operator times the complex conjugate of the annulus time signal, e.g., FFT (s(t)+ja(t)). The results are recombined so as to recover the real and imaginary parts of the FFT's for A(F) and S(F).

After the fundamental frequency $f_1$ and its harmonics are determined in logic box 207 from the frequency domain peaks, the cross-spectrum Csa between the two spectra A(t) and S(t) is determined in logic box 209. The coherence spectrum Csa is determined in logic box 211.

The cross-spectrum Csa is determined as the product between the standpipe spectrum $S(\omega)$ multiplied by the complex conjugate of the annulus spectrum $A^*(\omega)$. The power spectrum of a trace is determined as the product of its real and imaginary portions. Thus $C_{ss}=\text{Re } S(\omega)$ times $\text{Im } S(\omega)$; $C_{aa}=\text{Re } A(\omega)$ times $\text{Im } A(\omega)$. The power spectrum and cross-spectrum are preferably exponentially averaged, so as to insure that the coherence measurement of logic box 211 is meaningful.

The phase for each harmonic frequency is determined in logic box 213. It is preferred to determine such phase by determining:

$$\Phi_i = \tan^{-1}\frac{Im\ (Csa)}{Re\ (Csa)}$$

at each of the frequencies $f_1, f_2 \ldots$ as determined in logic box 207.

The logic box 215 labeled "UNWRAP $\Phi$" provides access to stored phase curves which are determined as:

$$\text{UNWRAP } \Phi_i \text{ present loop} = \Phi_{i\ present\ loop} + 2\pi \text{ JUMP}_{present\ loop}$$

The integer "JUMP" is incremented (or decremented) each time the difference between two consecutive values of the phase (determined from one calculation loop to the next):

$$\Phi_i\,(T_i)_{present\ loop} - \Phi_i\,(T_i)_{previous\ loop}$$

exceeds a level called UNWRAP THRESHOLD. The choice between incrementing or decrementing $\text{JUMP}_{present\ loop}$ depends on the sign of such difference of phase calculated between calculation loops. A preferred setting for the UNWRAP THRESHOLD value is $170/180\ \pi$.

The estimate of total transit time is performed in logic module 217. It calculates the Transit time as:

$$T_{i\ present\ loop} = (n_i - \text{UNWRAP } \Phi_{i\ present\ loop}/2\pi)/f_i$$

During the first pass through the loop, $n_{i\ present\ loop}$ is estimated from depth and mud weight as described above. Such estimates are made for each harmonic i as illustrated in logic modules 227 and 225. Logic module 225 estimates the initial $n_i$'s as $2\times$depth/sound speed, where the sound speed is $\sqrt{25\times10^8/p}$ where p is the mud weight in SI units.

Several techniques are preferred for modifying and eventually selecting the $n_i$ of any loop calculation.

(1) Ti present loop is not allowed to go negative. If this should occur, $n_{i\ present\ loop}$ is immediately incremented. Such a situation may occur in shallow boreholes.

(2) $T_{i\ present\ loop}$ is not allowed to exceed twice the theoretical round trip acoustic travel time. If it does, $n_{i\ present\ loop}$ is immediately decremented.

(3) If two consecutive values of $n_i$ present loop are different by more than a predetermined fraction of the considered period, then the current setting of $n_{i\ present\ loop}$ is incorrect. In other words, a step-like variation of $T_{i\ present\ loop}$ is not allowed because it is not physically realistic. A value of $n_i$ present loop is required such that $T_{i\ present\ loop}$ varies smoothly with time.

(4) The determination of $T_{i\ present\ loop}$ should not be a function of frequency. The sound propagation in typical drilling mud is obviously dispersive, but the frequency variation is in the order of one percent. Accordingly, advantage is taken of the natural jitter of the mud pumps. In other words, because the frequency of the mud pumps does vary, so does the total transit time of mud pump oscillations through the drilling system. The existence of frequency variations is used to correct for he problem caused by such variations in the first place. The correction is based on the determination of the derivative of $T_{i\ present\ loop}$ with respect to frequency $i_{present\ loop}$. Preferably a statistic of the signs of such derivative is used. For example if 75% of the previous loop derivatives are negative, then $n_i$ present loop is decreased, and vice versa.

Other requirements are also built into the logic steps of FIG. 12. The variation from each $T_{i\ present\ loop}$ from the present loop must be greater than 1 ms. The coherence of the measurements must be larger than a predetermined coherence threshold (e.g., 90%). The correction of time via logic box 217 is allowed only if the present time is within ±50% of the theoretical transit time e.g., 2 times depth/sound speed.

If no change in d Ti/d fi is determined after the "n loops" of logic boxes 219 and 217, the $T_i$'s are applied to logic box 221. Time differentials are determined by taking the difference between two consecutive time loop measurements. The time loop is indicated by lead 229 which starts again the entire determination of various $T_i$. Such time differentials are averaged over the different frequencies as indicated by the contents of logic box 221:

$$dT/dt = (\Sigma dTi/dt \cdot Csa)/\Sigma Csa.$$

Only certain $T_i$ are incorporated into the averaging process. This requirement substantially eliminates false alarms. It is preferred that the following conditions be required before a value of dT/dt is accepted from logic module 221.

(1) The dT/dt determined should be less than the fraction of a period used for the unwrapping threshold (as described above) or 100 milliseconds, whichever is the smallest.

(2) The coherence of the present time measurement as well as the preceding time measurement must be larger than the coherence threshold so as to exclude the very first points after the mud pumps are turned on and to suppress false alarms produced at transients.

(3) The pumps must be turned on, i.e., the standpipe signal s(t) must be greater than a predetermined minimum value.

(4) The relative frequency variation of the present time measurement is required to be less than 4% so as to exclude measurements produced when pump speed is modified.

Processing continues again via logic lead 229 to start a new time calculation for dT/dt. If dT/dt as determined from logic module 221 is greater than a predetermined value, preferably 12 milliseconds/minute, an alarm is created, e.g. by a bell, siren, flashing lights, etc., so as to alert the driller that a kick has been detected.

Figure 5:
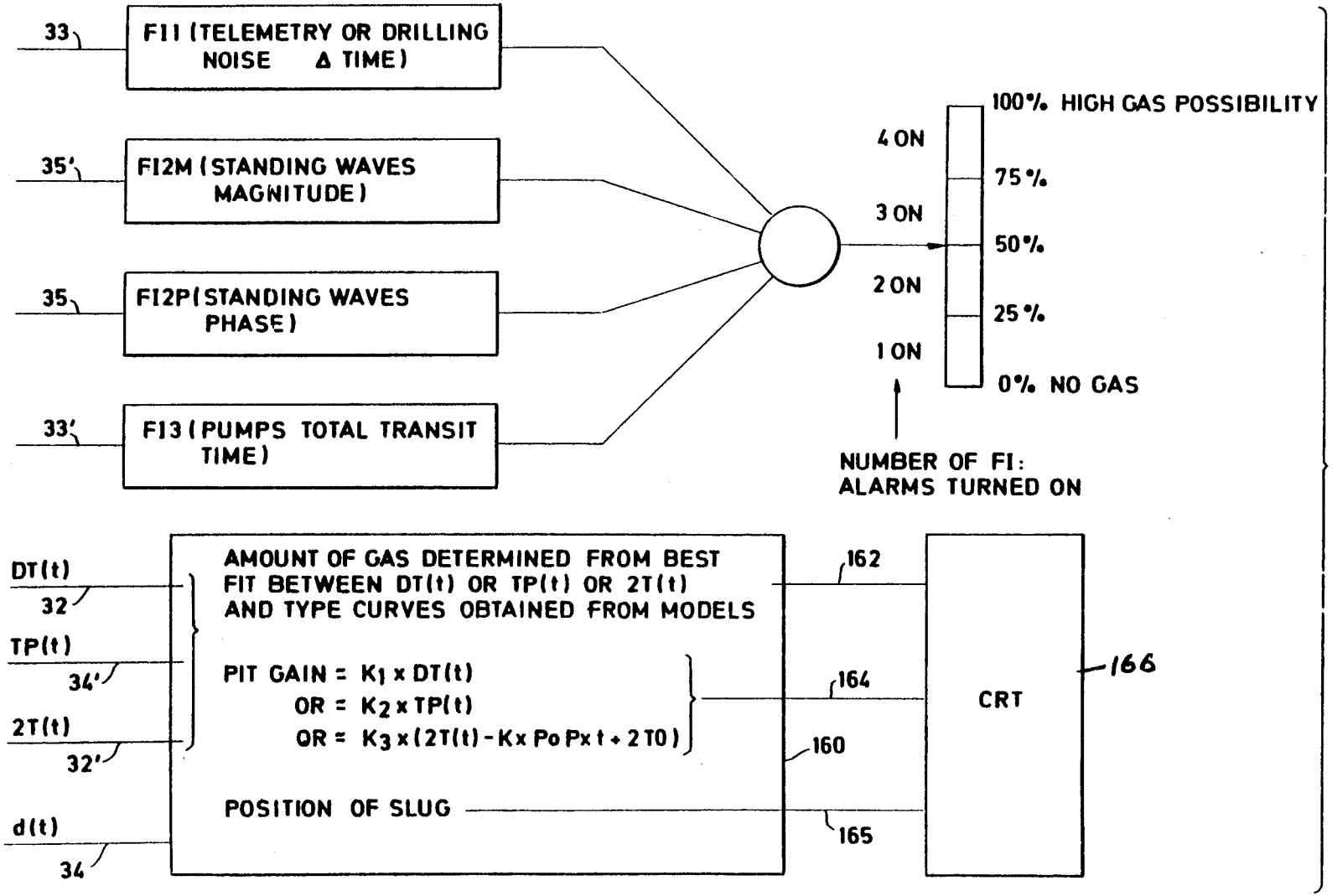
FIG. 5 illustrates system elements provided for insuring the accuracy of a fluid influx determination to create a driller's alarm information and for producing detailed information concerning the amount of gas such fluid influx and its effect on the mud volume in the rig mud pit.

If desired, an alarm signal from logic module 223 may be substituted for the signal $FI_2P$ (Standing Waves Phase) o lead 35 as illustrated in FIGS. 2, 4B and 5. In other words the module of FIG. 12 may be substituted for Module III of FIGS. 4B and 11.

Composite Analysis

FIG. 5 illustrates a preferred example of how the 4 basic individual fluid influx signals can be applied to Fluid Influx Analyzer 36. A consolidated fluid influx alarm is elaborated from the FI's in the following way: if none of the FI's is on, then the probability of there being a gas influx is set to zero. If one indicator FI turns on, then it is assured that a 25% chance of gas influx is present and a 25% display is set on the driller's console, 50% for 2 FI's, 75% for 3, and 100% when all four FI's are turned on.

It is of course possible to attribute more weight to one of the FI's and less to another in the computation of the consolidated alarm. For example, when only one pump is being used, the FI3 indicator does not exist and the remaining indicators apparatus, the FI1 indicator does not exist and the remaining indicators account for 33.3% each. On a well being drilled with only one pump and without MWD, the FI1 and FI3 indicators do not exist and the remaining indicators account for 50% each.

Still referring to FIG. 5, the DT(t) signal on lead 32 from the Delta Arrival Time Analyzer 28, the d(t) signal on lead 34 from the Standing Wave Analyzer 30, the 2T(t) signal on lead 32' from the total transit time analyzer 29, and the TP(t) signal on lead 34' from standing wave analyzer 30 are applied to kick or Fluid Influx Parameter module 160. Predetermined relationships f(DT(t), f(2T(t)), f(TP(t)), stored in computer memory, produce a signal on output lead 162 representative of the amount or magnitude of a gas influx slug, that is, $amt_{gas}(t)$.

Another predetermined relationship between the DT, 2T or TP signals and pit gain are stored in computer memory, and a pit gain signal as a function of t is applied on lead 164. The $amt_{gas}(t)$ signal and the PIT GAIN (t) signal may be presented on CRT display 166 or an alternative output device such as a printer, plotter, etc. The position of the gas slug may be applied to CRT 166 via lead 165.

Total Transit Analyzer—Beat Frequency Analysis

In another particularly preferred embodiment of the present invention, a third gas influx detection method can be used to back up the two previous ones in the case where two or more mud pumps are used in parallel. When this occurs, it is common practice to operate the pumps at approximately the same flowrate. Experience proves that this produces a beating frequency pressure wave in the standpipe and that these beatings propagate down and up in the annulus. The beating frequency, which is proportional to the difference in frequency of the two pumps, is usually very low, for example 0.1 Hz. A phase difference of the beats between standpipe and annulus is a direct measurement of the sonic travel time 2T down the drill string and up in the annulus, and therefore of the presence of gas if an exponential increase of such travel time is detected.

Figure 9:
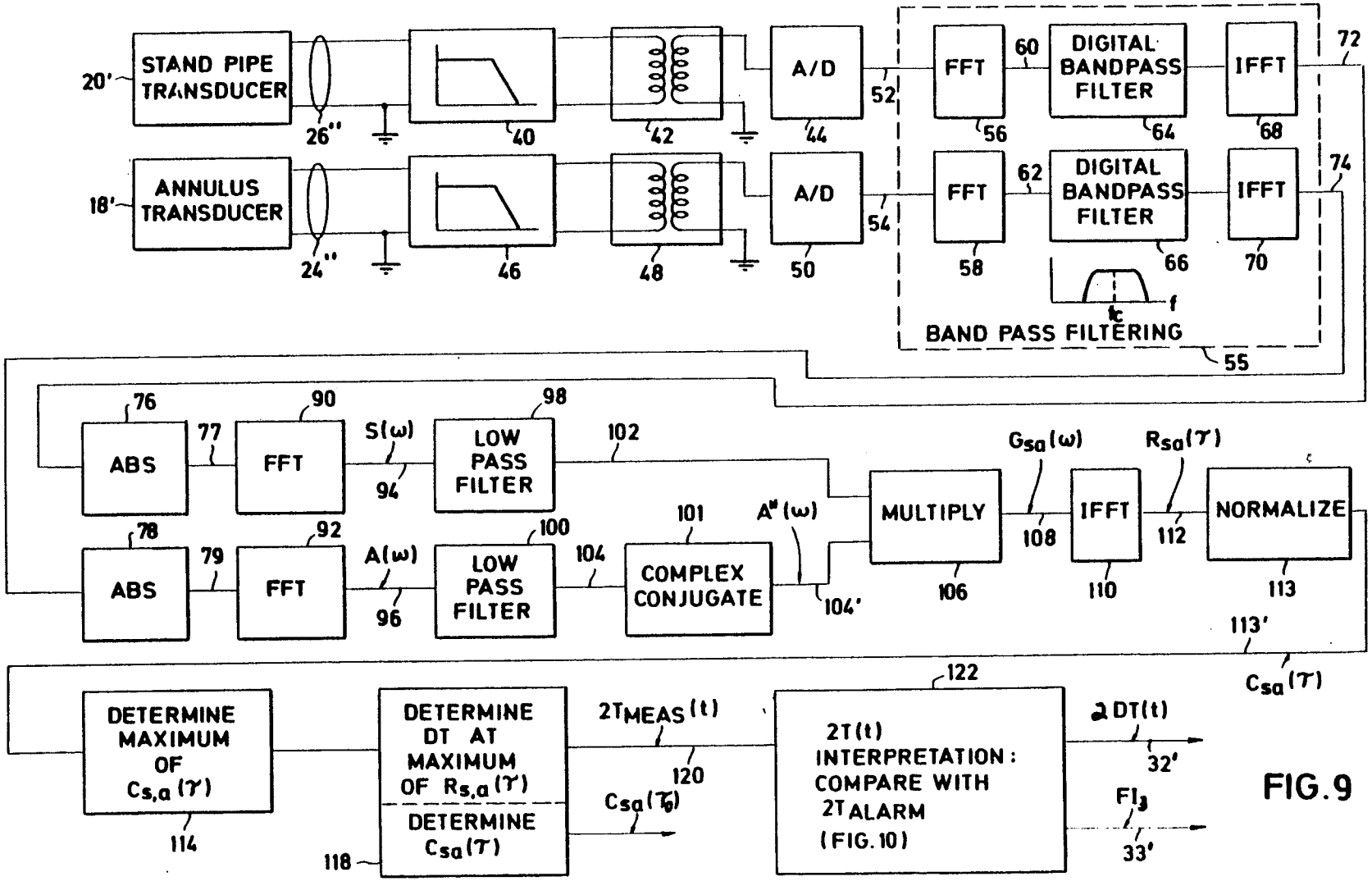
FIG. 9 is a block diagram showing the method used to measure 2T(t), the total transit he drill string and up the annulus in the case where pump beatings are present, the technique being similar to the one used for DT(t), the difference in arrival times from the downhole source.
Figure 10:
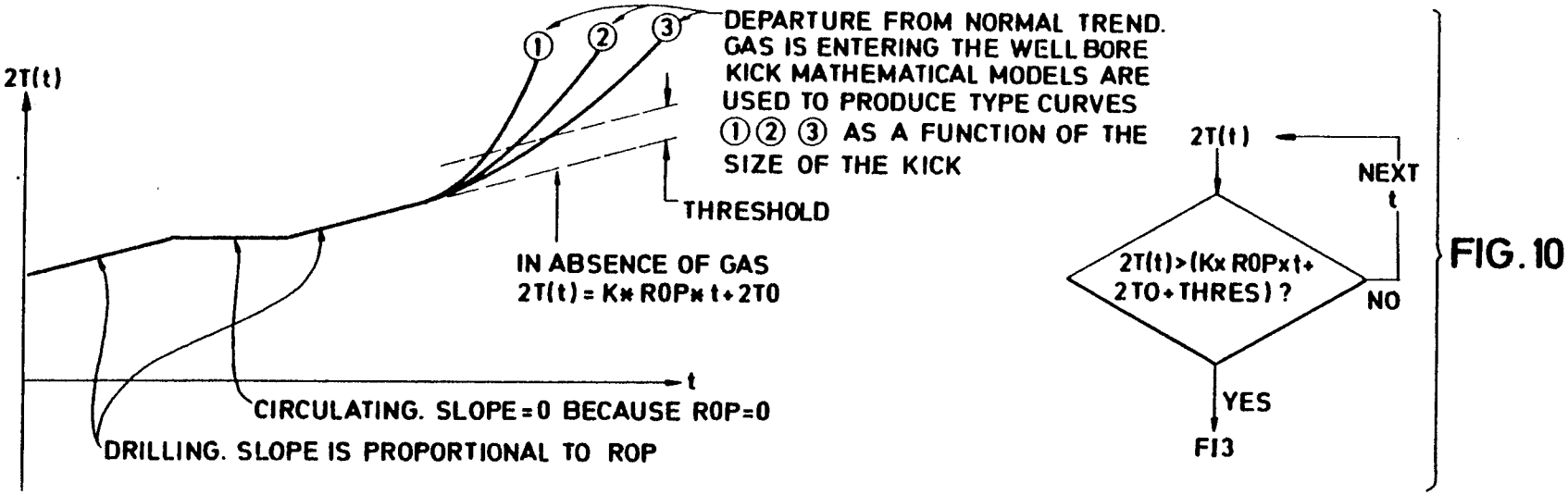
FIG. 10 illustrates 2T(t) signals which are produced by the apparatus of FIG. 9 and indicates processing steps used to identify the occurrence of a gas influx as well as to estimate its magnitude.

FIGS. 9 and 10 illustrate the pressure beating wave phase difference method and apparatus. FIG. 9 represents the total transit time analyzer 29 of FIG. 2 with inputs 26" and 24" from the standpipe transducer 20' and annulus transducer 18' FIG. 9 is identical in structure to that of FIG. 3 which illustrates the delta arrival time from a downhole source apparatus and method.

The band pass filtering of module 55 of FIG. 9 is set to the pump fundamental frequency. The same steps described above for FIG. 3 are repeated by module 55 of FIG. 9 with the exception that the output of logic module 118 is now the total travel time of the beat frequency wave, that is $2T_{meas}(t)$ which is applied to logic module 122 of FIG. 10.

Referring to FIG. 10, when the 2T(t) function is plotted as a function of time, it normally has an increasing slope with rate of penetration. If the 2T(t) slope increases dramatically, i.e., exponentially, such increase is an indication of a fluid influx. If the value of 2T(t) at any time t is greater than K×ROP×t+2T0+threshold then a third alarm $FI_3$ is generated on lead 33' as indicated in FIGS. 10 and 2.

The detection methods described above are complementary or confirmatory of each other because some are "integral" type of measurements and others are "differential". The delta arrival time analyzer apparatus and method which uses either the telemetry signal or the drilling noise as stimulation source is of the integral type. So is the total transit time analyzer apparatus and method which uses pumps beats propagation as well as the phase information of the standing waves analyzer apparatus and method. On the other hand, the magnitude information of the standing waves analyzer apparatus and method is of the "differential" type. The term integral is used in connection with the delta arrival time or total transit time or phase of standing waves methods, because they are sensitive to the average distribution of gas in the annulus along its entire height. Accordingly, it is difficult to assess from it alone all of the parameters characteristic of a gas influx into the borehole. For example, a small amount of gas at the top of the well has the same effect as a large amount of gas at the bottom of the well, because the gas is compressed at the bottom due to the large hydrostatic head there. In other words, the same amount of gas will have very different effects on the Delta T determination depending on the position of the gas slug in the annulus.

The magnitude of the standing wave analyzer method may be characterized as a differential measurement because it is the acoustic impedance difference or "break" at the interface between clean mud and gas cut mud as a result of gas influx that governs the peaks in the standing waves. Reflections take place at the location of the impedance break or at the location of different mud densities independently of th size of the region containing the gas cut mud.

Doppler Shift Embodiment

Another embodiment of the present invention is illustrated in FIGS. 13, 14A and 14B. FIG. 13 is a still more simplified representation of the drilling system as schematically represented in FIG. 4A. For the doppler shift embodiment of the present invention, it is assumed that a source of an acoustic signal is a mud pump or pumps 11 which generates an acoustic signal of fundamental frequency $f_o$.

As illustrated by FIG. 13, the acoustic signal from source 11 travels via the drill string 6 to the bottom of the hole and up the annulus 10 for a total distance D. Along the way, in the annulus, a gas influx may enter the well. A pressure signal representative of the pressure signal at the standpipe is produced by transducer 20'. A pressure signal representative of the pressure signal at the surface in the annulus is produced by transducer 18'.

The principle of detecting a gas influx into the annulus is to monitor the change of the speed of sound through the distance D as illustrated in FIG. 13. With no gas in the annulus, the speed of sound is approximately constant. The distance D between "transmitter" SPT transducer 20' and "receiver" APT transducer 18' changes very slowly during drilling; accordingly it can be regarded as constant. Likewise, the power spectrum $S(\omega)$ of the SPT signal and the power spectrum $A(\omega)$ of the APT signal are characterized by identical frequencies. If a frequency $f_o$ is present at the input SPT, the same frequency is measured at the output APT.

If an influx of gas into the borehole occurs, then the speed of sound in the annulus will be drastically reduced because of the gas compressibility, but of course the distance D is constant. This situation is similar in effect to a situation where s the speed of sound is constant, but the distance D increases.

The effect is the classical situation of a Doppler effect: a relative change of frequency Delta f/f proportional to v/c is produced whenever the source of sound is moving at a velocity v with respect to the receiver in a medium where the speed of sound is c. The detection technique consists of measuring accurately the frequency of the sound wave entering the system and picked up by the SPT transducer 20' as well as the frequency of the wave as it exits the system at the APT transducer 18'. An accurate determination of the frequency can be performed as follows:

Sample the SPT and APT time signals. Use N points at an interval Delta t. The intrinsic frequency resolution resulting from this procedure in Delta f=1/(N Delta t).

Calculate the magnitude of the FFT of the SPT and APT time traces. See FIGS. 14A and 14B illustrating $S(\omega)$ and $A(\omega)$.

Find the frequency corresponding to the position of the maximum in the spectrum.

A better accuracy is obtained by calculating the abscissa of the center of gravity of the peaks.

Determine the Doppler shift Delta f by calculating the difference between the SPT and APT frequencies as illustrated in FIG. 14B.

In a normal situation with no gas in the system, the frequency shift Delta f/f is zero. When gas flows into the well, Delta f/f increases. If it crosses a predetermined threshold, then an alarm is sounded.

Various modifications and alterations in the described methods and apparatus will be apparent to those skilled in the art of the foregoing description which does not depart from the spirit of the invention. For this reason, these changes are desired to be include in the appended claims. The appended claims recite the only limitation to the present invention. The descriptive manner which is employed for setting forth the embodiments should be interpreted a illustrative but not limitative.

What is claimed is:

1. In a borehole drilling system including a drill string terminated by a drill bit with said drill string defining an annulus between the outer diameter of said drill string and said borehole, said system including a drilling fluid pump for pumping drilling fluid downwardly through a standpipe and said drill string and upwardly through said annulus to the surface, apparatus for detecting fluid influx into the borehole comprising:

a) pressure detecting means near the surface of said system for generating an annulus pressure signal as a function of time which is representative of pressure oscillation of said drilling fluid in said annulus caused by steady state oscillations of said drilling fluid pump;

b) pressure detecting means near the surface of said system for generating a standpipe pressure signal as a function of time which is representative of pressure oscillation of said drilling fluid in said standpipe caused by said steady state oscillation of said drilling fluid pump;

c) means for determining phase difference as a function of time between said annulus pressure signal and said standpipe pressure at a particular oscillation frequency of said steady state oscillation of said drilling fluid caused by said drilling fluid pump;

d) means for periodically determining total transit time of a drilling fluid pressure wave along a path defined from said standpipe downwardly along said drill string and upwardly along said annulus to the surface as a function of said phase difference and said particular oscillation frequency;

e) means for determining time rate of change of said total transit time, and f) means for comparing said time rate of change of said total transit time with a predetermined limit to generate a kick alarm signal if such limit is exceeded.

2. The apparatus of claim 1 wherein said means for determining said total transmit time T at any time t includes means for evaluating the function $$T=(n-\Phi/2\pi)/f$$

where

Φ represents said phase difference, f represents said particular oscillation frequency, and n is an integer which is incremented or decremented until the rate of change of T with respect to frequency f is approximately zero.

3. In a borehole drilling system including a drill string terminated by a drill bit with said drill string defining an annulus between the outer diameter of said drill string and said borehole, said system including a drilling fluid pump for pumping drilling fluid downwardly through a standpipe and said drill string and upwardly through said annulus to the surface, a method for detecting fluid influx into the borehole comprising the steps of:

a) detecting near the surface of said system an annulus pressure signal as a function of time which is representative of pressure oscillation of said drilling fluid in said annulus caused by steady state oscillations of said drilling fluid pump;

b) detecting means near the surface of said system a standpipe pressure signal as a function of time which is representative of pressure oscillation of said drilling fluid in said standpipe caused by said steady state oscillations by said drilling fluid pump;

c) determining the phase difference as a function of time between said annulus pressure signal and said standpipe pressure signal at a particular oscillation frequency of said drilling fluid caused by said steady state oscillation of said drilling fluid pump;

d) determining total transit time as a function of time of a drilling fluid pressure wave along a path defined from said standpipe downwardly along said drill string and upwardly along said annulus to the surface as a function of said phase difference and said particular oscillation frequency;

e) determining time rate of change of said total transit time, and f) comparing said time rate of change of said total transit time with a predetermined limit to generate a kick alarm signal if such limit is exceeded.

4. The method of claim 3 wherein said step for determining the transmit time T at any time t includes the step of evaluating the function:

$$T=(n-\Phi/2\pi)/f$$

where

Φ represents said phase difference, f represents said particular oscillation frequency, and n is an integer which is incremented or decremented until the rate of change of T with respect to frequency is approximately zero.

5. In a borehole drilling system including a drill string terminated by a drill bit with said drill string defining an annulus between the outer diameter of said drill string and said borehole, said system including a drilling fluid pump for pumping drilling fluid downwardly through a standpipe and said drill string and upwardly through said annulus to the surface, a method for detecting fluid influx into the borehole comprising the steps of:

a) detecting near the surface of said system an annulus pressure signal as a function of time which is representative of pressure oscillation of said drilling fluid pump;

b) detecting near the surface of said system a standpipe pressure signal as a function of time which is representative of pressure oscillation of said drilling fluid in said standpipe caused by said drilling fluid pump;

c) determining the power spectrum $S(\omega)$ of said standpipe pressure signal;

d) determining the power spectrum $A(\omega)$ of said annuls pressure signal;

e) determining a characteristic frequency $f_o$ of said $S(\omega)$ spectrum;

f) determining a characteristic frequency $f_0'$ of said $A(\omega)$ spectrum;

g) determining the difference in frequency Delta f between said characteristic frequency $f_0'$ of said $A(\omega)$ spectrum and said characteristic frequency $f_0$ of said $S(\omega)$ spectrum;

h) comparing a signal proportional to the ratio of Delta $f/f_0$ with a predetermined threshold signal; and i) generating an alarm signal if Delta $f/f_0$ exceeds said threshold signal.

6. The method of claim 5 wherein said characteristic frequency $f_o$ of said $S(\omega)$ spectrum is that frequency in the spectrum corresponding to the position of the maximum amplitude of said $S(\omega)$ spectrum, and said characteristic frequency $f_0'$ of said $A(\omega)$ spectrum is that frequency in the spectrum corresponding to the position of the maximum amplitude of said $A(\omega)$ spectrum.

* * * * *